US011426631B2

(12) United States Patent
Eder

(10) Patent No.: US 11,426,631 B2
(45) Date of Patent: Aug. 30, 2022

(54) SENSOR DEVICE FOR EXERCISE APPARATUS AND METHODS THEREOF

(71) Applicant: INCLUDEHEALTH, INC., Mason, OH (US)

(72) Inventor: James Ryan Eder, Columbus, OH (US)

(73) Assignee: IncludeHealth, Inc., Mason, OH (US)

( * ) Notice: Subject to any disclaimer, the term of this patent is extended or adjusted under 35 U.S.C. 154(b) by 0 days.

(21) Appl. No.: 17/126,813

(22) Filed: Dec. 18, 2020

(65) Prior Publication Data

US 2021/0187352 A1 Jun. 24, 2021

Related U.S. Application Data

(60) Provisional application No. 62/950,200, filed on Dec. 19, 2019.

(51) Int. Cl.
*A63B 71/00* (2006.01)
*A63B 24/00* (2006.01)

(52) U.S. Cl.
CPC ..... *A63B 24/0062* (2013.01); *A63B 2220/17* (2013.01); *A63B 2220/833* (2013.01); *A63B 2225/50* (2013.01); *A63B 2225/74* (2020.08)

(58) Field of Classification Search
CPC ..... A63B 24/0062; A63B 2024/0071; A63B 24/00
USPC ..... 482/8, 9
See application file for complete search history.

(56) References Cited

U.S. PATENT DOCUMENTS 5,655,997 A 8/1997 Greenberg et al.
6,702,719 B1 * 3/2004 Brown ..... G16H 10/60 482/8
6,705,976 B1 3/2004 Paine, Jr.
7,192,387 B2 * 3/2007 Mendel ..... A63B 24/00 482/8
7,220,220 B2 * 5/2007 Stubbs ..... A63B 22/00 482/72
7,455,621 B1 * 11/2008 Anthony ..... A63B 21/0724 482/3
7,682,294 B2 3/2010 Paine, Jr.
7,771,319 B1 8/2010 Spoeth
8,172,723 B1 * 5/2012 Yanev ..... A63B 24/0062 482/8

(Continued)

FOREIGN PATENT DOCUMENTS

EP 2233176 A1 9/2010
WO 2017037411 A1 9/2017

OTHER PUBLICATIONS

Young, Lee; International Search Report and Written Opinion of the International Searching Authority, issued in International Application No. PCT/US2020/066019; dated Apr. 29, 2021; 14 pages.

(Continued)

*Primary Examiner* — Alvin A Hunter
(74) *Attorney, Agent, or Firm* — Ulmer & Berne LLP

(57) ABSTRACT

A sensor device for exercise data tracking includes a mounting clip that can be coupled to an exercise apparatus. A housing with one or more sensor can be selectably coupled to the mounting clip. During use of the exercise apparatus, the sensor device can track exercise data and wirelessly provide the data to a receiver.

21 Claims, 14 Drawing Sheets

(56) References Cited

U.S. PATENT DOCUMENTS

| | | | | |
|---|---|---|---|---|
| 8,337,365 | B2 * | 12/2012 | Kim | A63B 21/065 482/8 |
| 8,690,735 | B2 | 4/2014 | Watterson et al. | |
| 8,814,754 | B2 * | 8/2014 | Weast | A61B 5/681 482/8 |
| 8,827,870 | B2 | 9/2014 | Dyer et al. | |
| 9,409,053 | B1 * | 8/2016 | Todd | G16H 20/30 |
| 9,616,292 | B2 * | 4/2017 | Orfield | A63B 21/0628 |
| 9,669,261 | B2 | 6/2017 | Eder | |
| 9,907,999 | B2 * | 3/2018 | Yu | G06F 3/067 |
| 10,130,842 | B2 | 11/2018 | Eder | |
| 10,709,955 | B2 * | 7/2020 | Elford | A63B 71/0616 |
| 10,737,140 | B2 * | 8/2020 | Rothman | A63B 24/0087 |
| 10,943,695 | B2 * | 3/2021 | Lindman | A61B 5/6895 |
| 2004/0102931 | A1 | 5/2004 | Ellis et al. | |
| 2005/0272561 | A1 | 12/2005 | Cammerata | |
| 2006/0094569 | A1 | 5/2006 | Day | |
| 2007/0054786 | A1 | 3/2007 | Paine, Jr. | |
| 2007/0219059 | A1 | 9/2007 | Schwartz | |
| 2011/0059825 | A1 | 3/2011 | McGown | |
| 2012/0289354 | A1 | 11/2012 | Cottam et al. | |
| 2014/0121071 | A1 | 5/2014 | Strom et al. | |
| 2015/0335951 | A1 | 11/2015 | Eder | |
| 2017/0106240 | A1 | 4/2017 | Chuang | |
| 2017/0165524 | A1 | 6/2017 | Eder | |
| 2018/0099184 | A1 | 4/2018 | Eder | |

OTHER PUBLICATIONS

Copenheaver, Blaine R.; International Search Report; PCT/US2017/055903; dated Dec. 15, 2017; 3 pages.

Copenheaver, Blaine R.; Written Opinion of the Int'l Searching Authority; PCT/US2017/055903; dated Dec. 15, 2017; 6 pages.

Herry, Manuel; Extended European Search Report issued in European Patent Application No. 17859764.7; dated Apr. 23, 2020; 7 pages.

* cited by examiner

SENSOR DEVICE FOR EXERCISE APPARATUS AND METHODS THEREOF

CROSS-REFERENCE TO RELATED APPLICATIONS

This application claims the benefit of U.S. Ser. No. 62/950,200, filed on Dec. 19, 2019, the disclosure of which is incorporated herein by reference in its entirety.

BACKGROUND

Many pieces of exercise equipment, when utilized regularly, are very useful for weight loss, for improving cardiovascular stamina, and for strengthening various muscles. Some exercise equipment can be used for rehabilitative or therapeutic purposes.

BRIEF DESCRIPTION OF THE DRAWINGS

It is believed that certain embodiments will be better understood from the following description taken in conjunction with the accompanying drawings, in which like references indicate similar elements and in which.

DETAILED DESCRIPTION

Figure 1:
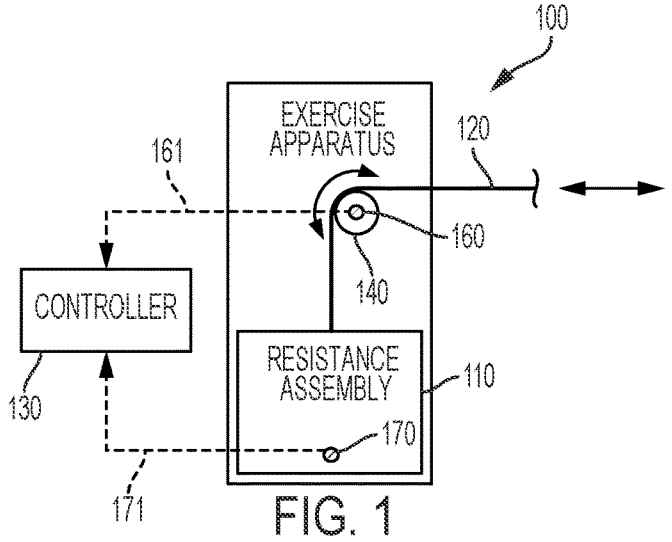
FIG. 1 schematically depicts an example exercise apparatus in accordance with one non-limiting embodiment.

Various non-limiting embodiments of the present disclosure will now be described to provide an overall understanding of the principles of the structure, function, and use of systems, apparatuses, devices, and methods disclosed. One or more examples of these non-limiting embodiments are illustrated in the selected examples disclosed and described in detail with reference made to FIGS. 1-22B in the accompanying drawings. Those of ordinary skill in the art will understand that systems, apparatuses, devices, and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

The systems, apparatuses, devices, and methods disclosed herein are described in detail by way of examples and with reference to the figures. The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such. Any failure to specifically describe a combination or sub-combination of components should not be understood as an indication that any combination or sub-combination is not possible. It will be appreciated that modifications to disclosed and described examples, arrangements, configurations, components, elements, apparatuses, devices, systems, methods, etc. can be made and may be desired for a specific application. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

Throughout this disclosure, references to components or modules generally refer to items that logically can be grouped together to perform a function or group of related functions. Like reference numerals are generally intended to refer to the same or similar components. Components and modules can be implemented in software, hardware, or a combination of software and hardware. The term "software"

is used expansively to include not only executable code, for example machine-executable or machine-interpretable instructions, but also data structures, data stores and computing instructions stored in any suitable electronic format, including firmware, and embedded software. The terms "information" and "data" are used expansively and includes a wide variety of electronic information, including executable code; content such as text, video data, and audio data, among others; and various codes or flags. The terms "information," "data," and "content" are sometimes used interchangeably when permitted by context. It should be noted that although for clarity and to aid in understanding some examples discussed herein might describe specific features or functions as part of a specific component or module, or as occurring at a specific layer of a computing device (for example, a hardware layer, operating system layer, or application layer), those features or functions may be implemented as part of a different component or module or operated at a different layer of a communication protocol stack. Those of ordinary skill in the art will recognize that the systems, apparatuses, devices, and methods described herein can be applied to, or easily modified for use with, other types of equipment, can use other arrangements of computing systems, and can use other protocols, or operate at other layers in communication protocol stacks, than are described.

The systems, apparatuses, devices, and methods disclosed herein generally relate to providing tracking of an individual's interaction with an exercise apparatus using one or more sensors incorporated therein. As used herein, the term exercise apparatuses is to broadly include any type of exercise or fitness machine, system, or device in which a user selects a resistance amount and then interacts with one or more interaction members, such as a handle, bar, lever, or pedals, to perform an exercise. The exercise apparatuses described herein are not limited to any particular style or type of apparatus and can include apparatuses that are single-station or multi-station devices.

As is to be appreciated upon consideration of the present disclosure, various aspects of an individual's interaction can be tracked, such as, without limitation, an amount of weight/resistance selected, a number of repetitions, a number of sets, duration of repetition, duration of sets, duration of workout, length of stroke, muscle group used, type of exercise, and so forth. Based on the data collected from the individual's interaction, various metrics can be captured by systems, apparatuses, devices, and methods described herein, such as calories burned, and so forth. The particular types of interactions that can be tracked may vary based on the type and location of sensors incorporated into the exercise apparatus.

As described in more detail below, the systems, apparatuses, devices, and methods can facilitate user recognition to aid in tracking a user's interaction with the exercise apparatus. In some embodiments, based on the recognition of the user, appropriate information is pulled from a data store and provided to the user. Data can include, for instance, a list of routines can be displayed on a visual display at the exercise apparatus, either on a networked connected client device or on the exercise apparatus itself. In some embodiments, exercise data can be collected, transmitted and stored to a profile of the user in a fitness tracking computing system, which may be local or remote to the exercise device. Based on a user profile, the individual's interaction with the exercise device can then be tracked over multiple interactions with the exercise device. Example fitness tracking computing systems are described in U.S. Pat. No. 9,669,261, issued Jun. 6, 2017, and U.S. Pat. App. Pub. No. 2015/0335951, filed on May 20, 2015, the disclosures of which are herein incorporated by reference in their entireties.

FIG. 1 schematically depicts an example exercise apparatus 100 in accordance with one non-limiting embodiment. The exercise apparatus 100 has a resistance assembly 110 which has a selective resistance. For instance, the resistance assembly 110 can include a weight stack having a plurality of weight plates that can be selected by a locking pin. The resistance assembly 110 is linked to a flexible member 120 which extends to an interaction member (not shown), such as a handle, bar, lever, etc. The flexible member 120 can be formed of nylon cable, although various other flexible members including metal cables, ropes, cords, and chains of suitable tensile strength are contemplated. The flexible member 120 operatively engages at least one pulley 140 which can be positioned at any suitable position, such as within a housing of the exercise apparatus 100 or outside the housing (i.e., proximate to an interaction member). The configuration of the pulley 140 causes any force that is transmitted through the flexible member 120 to be directed toward upwardly lifting a predetermined number of weight plates of a corresponding weight stack, or otherwise interacting with the resistance device.

The exercise apparatus 100 also includes a sensor network comprised of one or more sensors for tracking a user's interaction. In the illustrated embodiment, a first sensor 160 is positioned proximate to the pulley 140 and second sensor 170 is positioned proximate to the resistance assembly 110. Referring to the first sensor 160, any suitable sensor can be used that generates an output based on rotational movement of the pulley 140. For instance, in some configurations the first sensor 160 is an optical sensor or a magnetic sensor. With regard to optical sensors, any suitable sensing technique can be used, such as reflective optical sensor or an interrupter sensor. Furthermore, the first sensor 160 (or another sensor associated therewith) can provide rotation direction information, such as through an optical encoder. The first sensor 160 can be in communication with a controller 130 through a communication coupling 161. The communication coupling 161 can be a wired or wireless.

Referring to the second sensor 170, any suitable sensor can be used that generates an output based on the amount of resistance selected by the user. For the purposes of illustration, the amount of resistance will be described herein in terms of weight. It is to be appreciated that other forms of resistance can be used, such as pneumatic resistance, frictional resistance, and so forth, and the second sensor 170 can be configured to generate a signal indicative of the amount of resistance selected by the user. With reference to embodiments using a weight stack, the second sensor 170 can be, for example, a load cell positioned beneath the weight stack. As portions of the weight stack are lifted off the stack, the load cell generates a corresponding signal and provides it to the controller 130 via a communication coupling 171. The communication coupling 171 can be a wired or wireless. The second sensor 170 can therefore generate a signal at a first level when the entire weight stack is static based on the force of the entire weight stack applied to the second sensor 170. When any number of plates are lifted off the weight stack during an exercise, only the remaining portion of the weight stack applies force to the second sensor 170. The signal generated by the second senor 170 will therefor vary based on the weight of the plates that are lifted off the weight stack and can be used to ascertain the amount of weight used for a particular exercise. Additional example of load cell signaling is provided below in FIGS. 8-9.

The controller 130 can be configured with a profile for the exercise apparatus 100 so that proper exercise tracking can be performed. For example, the controller 130 can be configured to interpret the signals received from the first and second sensors 160, 170 to convert the signals into quantified exercise data, such as weight amount, number of repetitions, number of sets, stroke distance, stroke speed, etc. The controller 140 can also be configured with the ratio (i.e., 4:1, 2:1, 1:1, etc.) of the exercise apparatus 100 so that movements of the pulley 140 and the resistance assembly 110 can be properly correlated.

Figure 2:
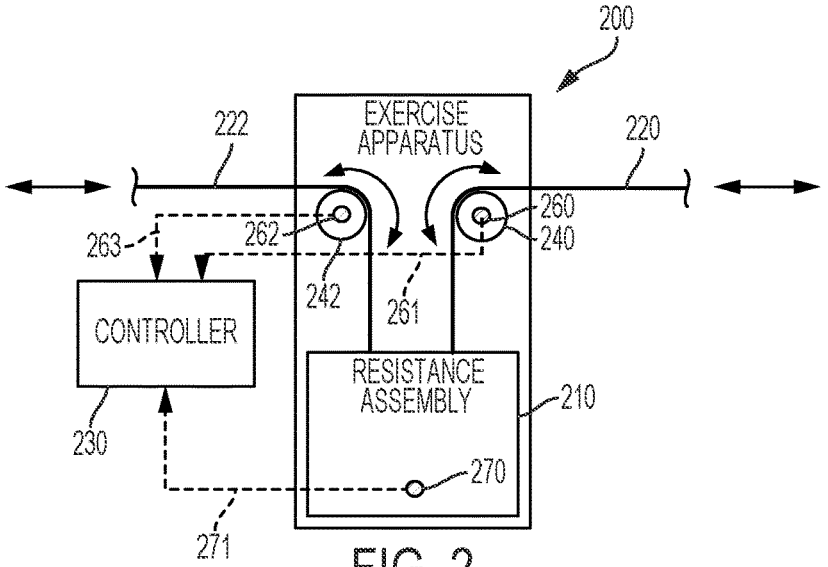
FIG. 2 schematically depicts an example exercise apparatus in accordance with one non-limiting embodiment.

While FIG. 1 depicts an exercise apparatus 100 having two sensors, any number of sensors may be used to provide the desired optics into a user's interaction with the apparatus. FIG. 2 illustrates a non-limiting embodiment of an exercise apparatus 200, the exercise apparatus 200 being similar to, or the same as in many respects as, the exercise apparatus 200 illustrated in FIG. 1. For example, the exercise apparatus 200 has a resistance assembly 210 with an associated sensor 270 that provides signaling to a controller 230 via communication coupling 271. The exercise apparatus 200 also has a pulley 240 for routing a flexible member 220, with the rotation of the pulley 240 being tracked by a sensor 260. The sensor 260 provides signaling to the controller 230 via communication coupling 261. However, in this embodiment, the exercise apparatus 200 has another flexible member 222 that is coupled to the resistance assembly 210 and is routed through a pulley 242. It is to be appreciated, that additional pulleys beyond those shown in FIG. 2 may be utilized without departing from the scope of the current disclosure. A sensor 262 is associated with the pulley 242 that provides rotational information to the controller 230 via a communication coupling 262. In some configurations, a user's right arm may be used to apply force to the flexible member 220 and a user's left arm may be used to apply force to the flexible member 222. Such forces may be applied concurrently or sequentially. In any event, the movement of the pulley 240 associated with the right arm and the movement of the pulley 242 associated with the left arm can be provided to the controller 230. Using the information obtained from the sensors 240, 242, 270, the controller 230 can track the user's performance. More specifically, based on the separate signals received from the pulley 240 and the pulley 242, the user's performance of one arm can be tracked independently of the user's performance of the other arm.

Figure 3:
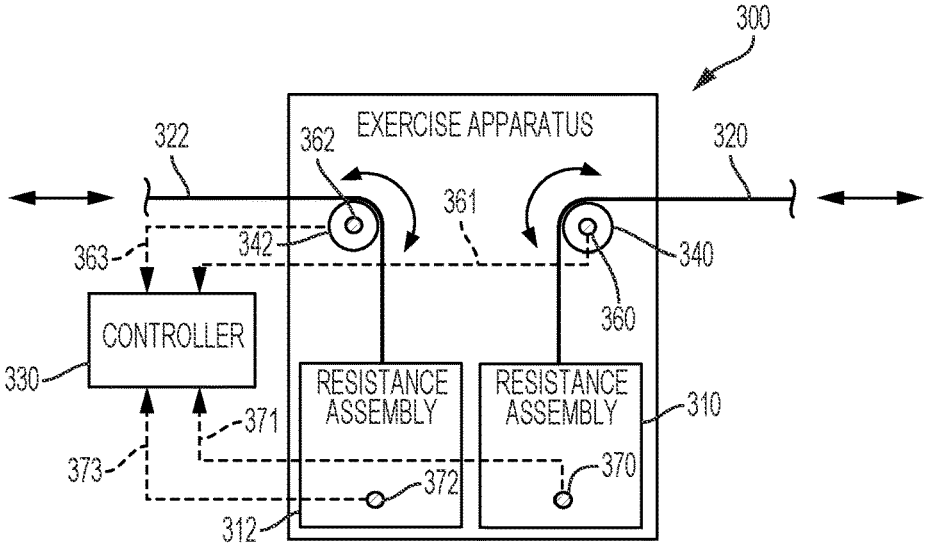
FIG. 3 schematically depicts an example exercise apparatus in accordance with one non-limiting embodiment.

FIG. 3 illustrates another non-limiting embodiment of an exercise apparatus 300, the exercise apparatus 300 being similar to, or the same as in many respects as, the exercise apparatus 200 illustrated in FIG. 2. For example, the exercise apparatus 300 has a resistance assembly 310 with an associated sensor 370 that provides signaling to a controller 330 via communication coupling 371. The exercise apparatus 300 also has pulleys 340, 342 for routing flexible members 320, 322. The rotation of each of the pulleys 340, 342 is tracked by sensors 360, 362, with signaling provided to the controller 330 via communication couplings 361, 363. However, in this embodiment, the exercise apparatus 300 has another resistance assembly 312. The resistance assembly 312 in the illustrated embodiment is coupled to the flexible member 322. Multiple resistance assemblies may be used, for example, in multi-station exercise machines. A sensor 372 is associated with the resistance assembly 312 that generates an output based on the amount of resistance selected by the user. Similar to the embodiments described above, the sensor 372 can be a load cell positioned beneath a weight stack, such that as portions of the weight stack are lifted off the stack, the load cell generates a corresponding signal and provides it to the controller 330 via a communication coupling 373. The communication coupling 373 can be a wired or wireless.

Figure 4:
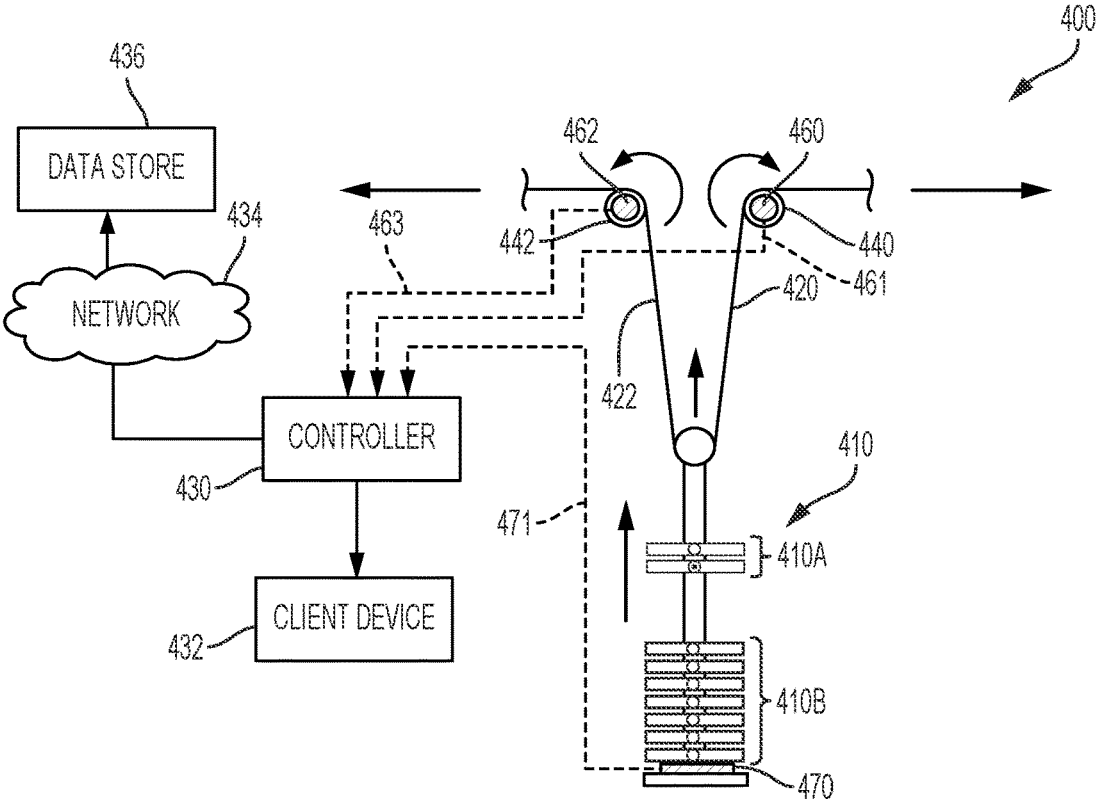
FIG. 4 schematically depicts an example exercise apparatus in accordance with one non-limiting embodiment.

Referring now to FIG. 4, an exercise apparatus 400 is depicted having a resistance assembly 410 that includes a plurality of weight plates. The exercise apparatus 400 is similar to, or the same as in many respects as, the exercise apparatus 200 illustrated in FIG. 2. For example, the exercise apparatus 400 has a sensor 470 associated with the resistance assembly 410 that provides signaling to a controller 430 via communication coupling 471. The exercise apparatus 400 also has pulleys 440, 442 for routing flexible members 420, 422. The rotation of each of the pulleys 440, 442 is tracked by sensors 460, 462, with signaling provided to the controller 430 via communication couplings 461, 463. The exercise apparatus 400 is shown in-use, with a first portion 410A of the weight plates being lifted off the weight stack. As such, the remaining portion 410B exerts a certain force on the sensor 470 which is provided to the controller 430 and can be correlated to a particular weight. FIG. 4 also schematically depicts that the controller 430 can be in networked communication with various devices, which may be local devices and/or remote devices. Furthermore, the networked communications may utilized wired communication protocols or wireless communication protocols. In the illustrated embodiment, the controller 430 is shown to be in communication with a client device 432. The client device 432 can be for example, without limitation, a smart phone, a tablet computer, a laptop, a wearable, and so forth. The controller 430 is also shown to be in communication with a data store 436 through a network 434. The network 434 can be an electronic communications network and can include, but is not limited to, the Internet, LANs, WANs, GPRS networks, other networks, or combinations thereof. The network 434 can include wired, wireless, fiber optic, other connections, or combinations thereof. In general, the network 434 can be any combination of connections and protocols that will support communications between the controller 430 and the data store 436. The data store 436 can store information associated with the user's past interaction with the exercise apparatus 400.

Figure 5:
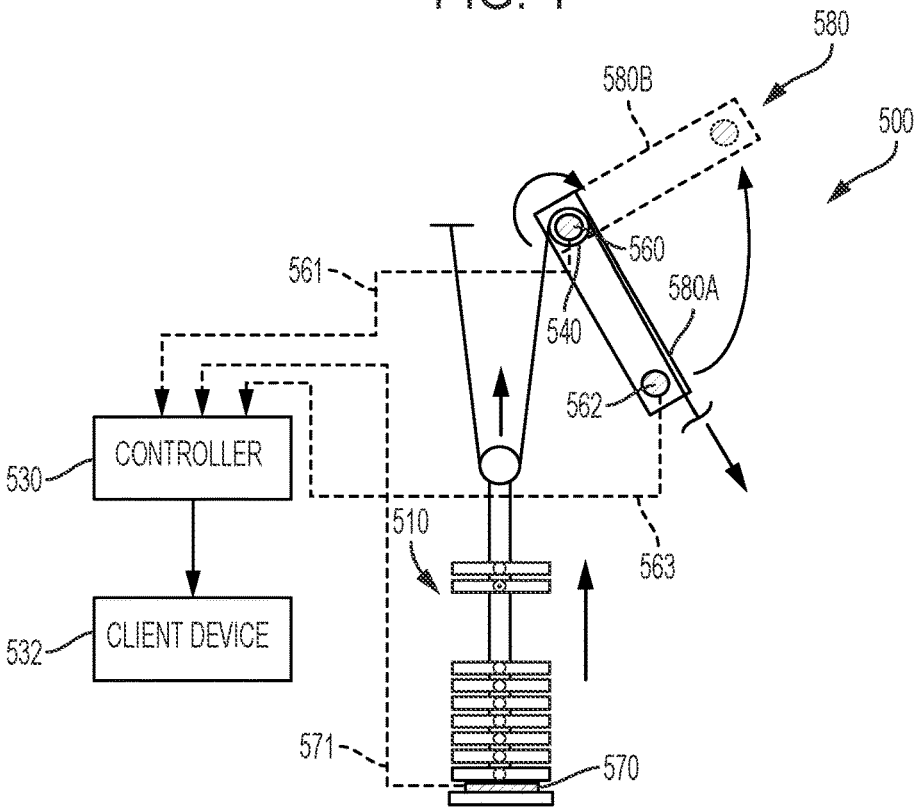
FIG. 5 schematically depicts an example exercise apparatus in accordance with one non-limiting embodiment.

FIG. 5 depicts another example exercise apparatus 500. The exercise apparatus 500 is similar to, or the same as in many respects as, the exercise apparatus 400 illustrated in FIG. 4. For example, the exercise apparatus 500 has a sensor 570 associated with the resistance assembly 510 that provides signaling to a controller 530 via communication coupling 571. The exercise apparatus 500 also has a pulley 540 for routing a flexible member 520. The rotation of the pulley 540 is tracked by a sensor 560, with signaling provided to the controller 530 via communication coupling 561. A client device 532 is shown in communication with the controller 530. The exercise apparatus 500 also has a movable member 580, which is movable between a first position (shown as 580A) and a second position (shown as 580B). While the movable member 580 is schematically shown as an extension arm, it is to be appreciated that the movable member 580 can be any of a variety of movement components of an exercise apparatus. Non-limiting examples of movable members include shuttles, seat backs, seat bottoms, pins, levers, lap bars, etc. In some embodiments, a moveable member may be included on another moveable member (such as a shuttle that is configured to translate along a track of a movable extension arm assembly). In any event, a sensor 562 can be associated with the moveable member(s) 580 such that the position of the moveable member(s) 580 can be provided to the controller 530 via a communication coupling 563. Using the information from the sensor 562, the controller 530 can determined, for instance, a type of exercise being performed on the exercise apparatus 500, as well as other quantified exercise data. The type of sensor 562 can vary based on the moveable member, but in some embodiments, the sensor 562 is a hall-effect sensor.

Figure 6:
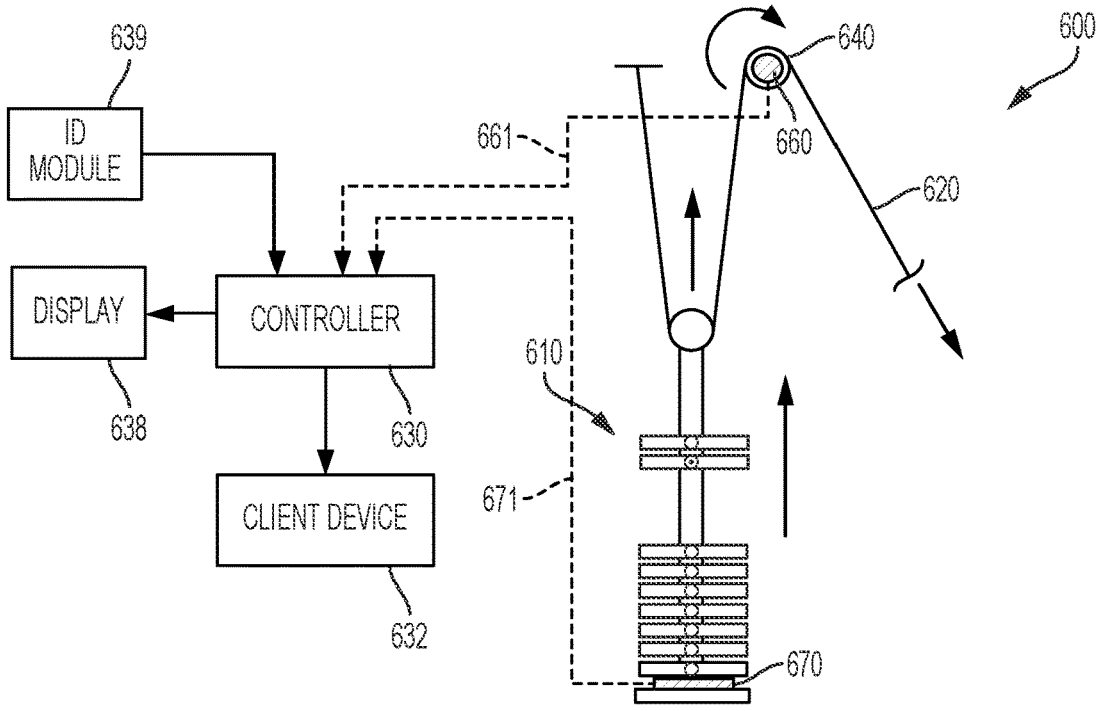
FIG. 6 schematically depicts an example exercise apparatus in accordance with one non-limiting embodiment.

Referring now to FIG. 6, an example exercise apparatus 600 is depicting having a sensor 670 associated with the resistance assembly 610 that provides signaling to a controller 630 via communication coupling 671. The exercise apparatus 600 also has a pulley 640 for routing a flexible member 620. The rotation of the pulley 640 is tracked by a sensor 660, with signaling provided to the controller 630 via communication coupling 661. A client device 632 is shown in communication with the controller 630. In this embodiment, the exercise apparatus 600 has an identification module 639 that is used to receive identifying data from the user, referred to as user indicia. The identification module 639 can include, for example, a non-contacting sensor and a wireless communication identification module. For example, when a user approaches the exercise apparatus 600 the non-contacting sensor can generate a signal instructing the wireless communication identification module to transmit a polling signal. In some embodiments the wireless communication identification module comprises any of a radio frequency identifier (RFID) module, an 802.11 wireless module, a Bluetooth module, or combinations thereof. Once user identifying information has been received by the exercise apparatus 600, a user indicia message can be provided a display 638, as illustrated in FIG. 6. Based on signals generated by the one or more sensors, exercise data is provided to the controller 630. Subsequent to a user exercising, or in substantially real-time, one or more messages comprising exercise event data can be displayed on the display 638 and/or transmitted to the client device 632.

Figure 7:
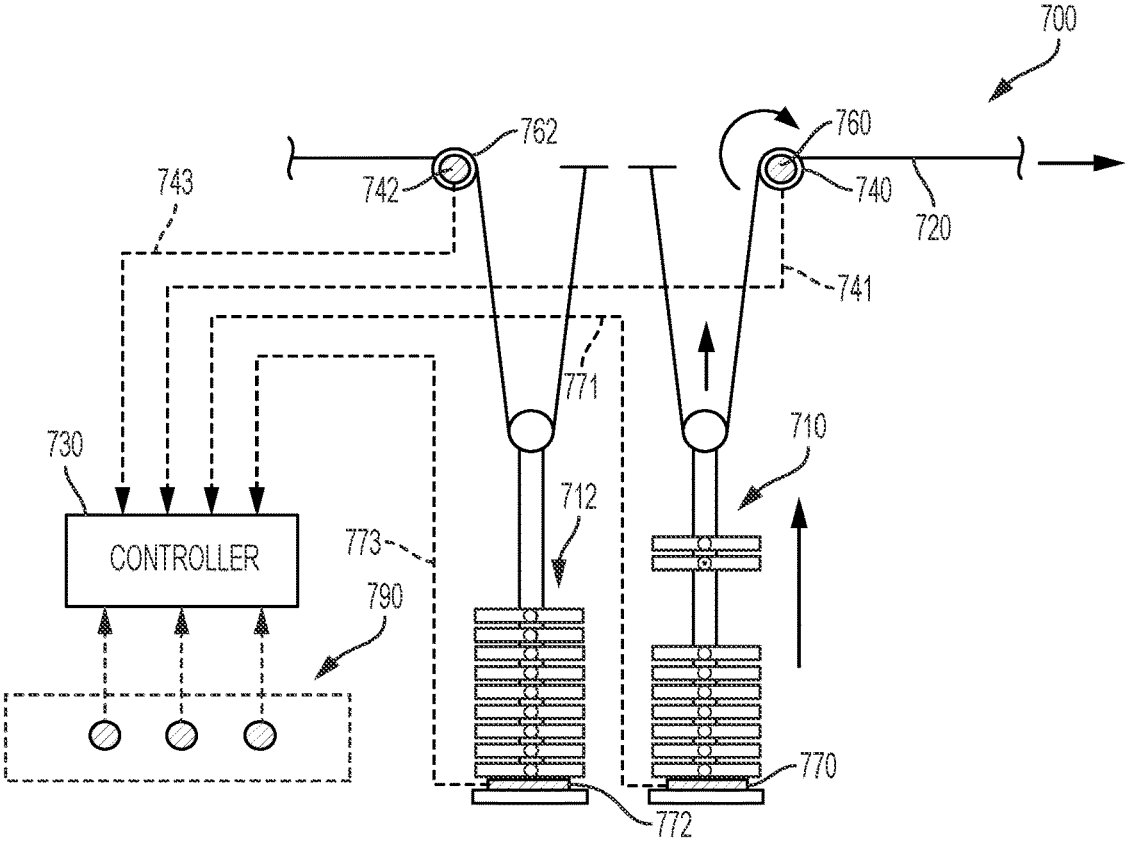
FIG. 7 schematically depicts an example exercise apparatus in accordance with one non-limiting embodiment.

Referring now to FIG. 7, an example exercise apparatus 700 is depicted, the exercise apparatus 700 being similar to, or the same as in many respects as, the exercise apparatus 300 illustrated in FIG. 3. For example, the exercise apparatus 700 has a resistance assemblies 710, 712 that are each associated with a respective sensor 770, 772. The sensors 770, 772 provide signaling to a controller 730 via communication couplings 771, 773. The exercise apparatus 700 also has pulleys 740, 742 for routing flexible members 720, 722. The rotation of each of the pulleys 740, 742 is tracked by sensors 760, 762, with signaling provided to the controller 730 via communication couplings 761, 763. However, in this embodiment, additional sensors 790 are illustrated to depict that the exercise apparatus 700 can simultaneously track a variety of data, such as positions of multiple components. The additional sensor 790 can each be placed at appropriate positions on the exercise apparatus 700 to generate signaling for processing by the controller 730 to determine quantified exercise data.

Figure 8:
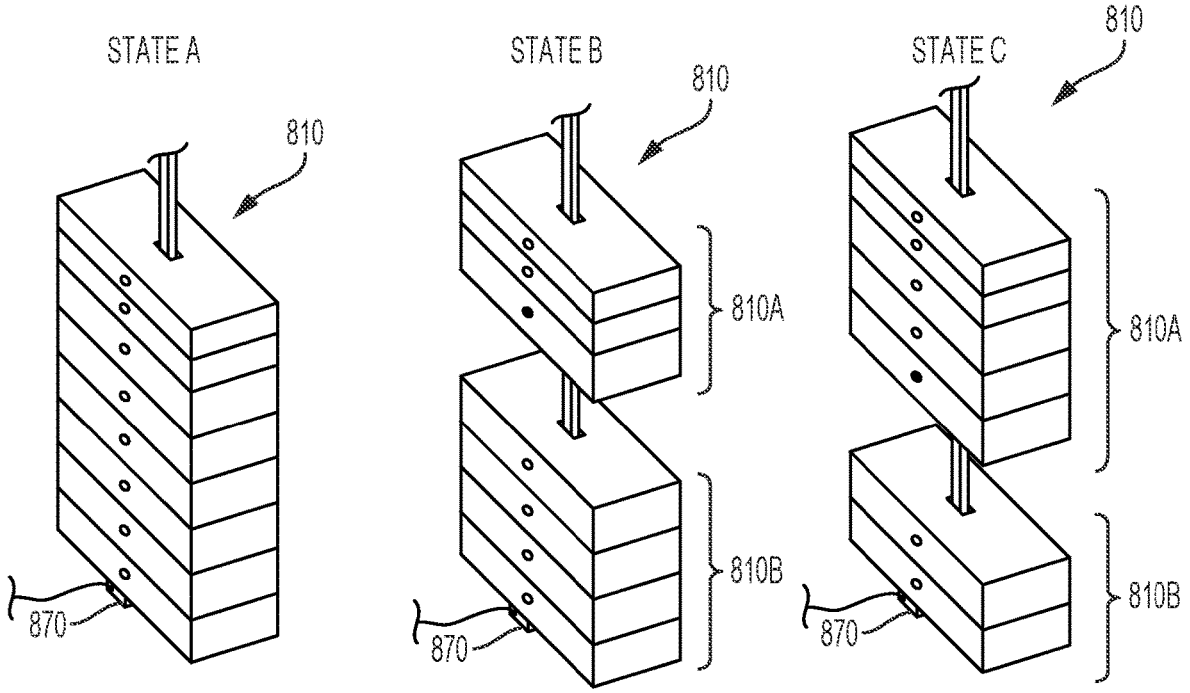
FIG. 8 depicts an example weight stack in three operational states.

Referring now to FIG. 8 an example weight stack 810 of an exercise apparatus in accordance with the present disclosure is depicted in three different operational states. A load cell 870 is positioned between the weight stack 810 and a frame (not shown) and generates a signal based on the amount of force applied thereto, as described above. State A depicts the weight stack 810 in a static position, such as when no one is using the exercise apparatus or the user is in the process of selecting a weight about. In State A, the entire weight stack 810 exerts force upon the load cell 870. State B depicts the weight stack 810 in an in-use position, with a first portion of weight plates 810A lifted away from the second portion of weight plates 810B. In State B, the second portion of weight plates 810B is exerting force upon the load cell 870. State C depicts the weight stack 810 in another in-use position, with a first portion of weight plates 810A lifted away from the second portion of weight plates 810B, such that the second portion of weight plates 810B is exerting force upon the load cell 870. State C has a larger number of weights in the first portion of weight plates 810A than State B (i.e., the user is lifting more weight in State C than State B).

Figure 9:
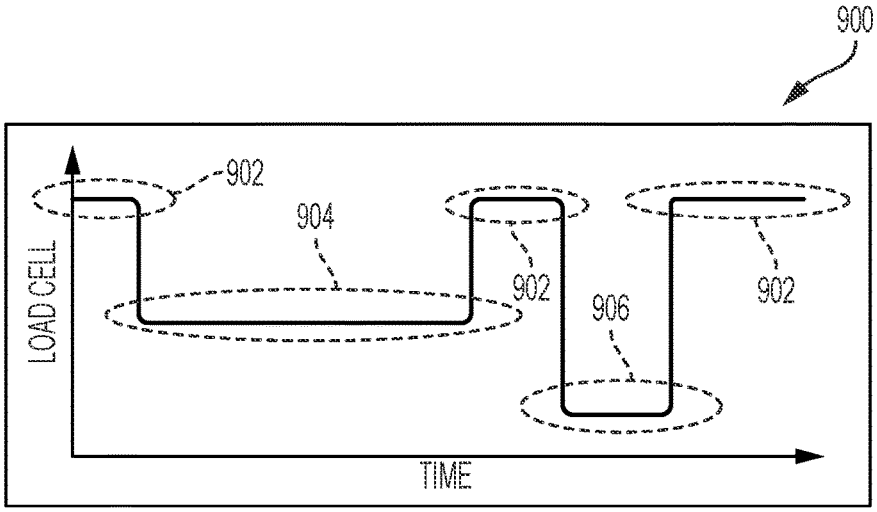
FIG. 9 is a chart depicting the signal generated by the load cell shown in FIG. 8 over time.

FIG. 9 is a chart 900 depicting the signal generated by the load cell 870 of FIG. 8 over time. The level of the signal is shown to vary in response to the states of the weight stack 810. In particular the signal level in zones 902 corresponds with State A, the signal level in zone 904 corresponds with State B, and the signal level in zone 906 corresponds with State C. A controller interpreting the signals received from the load cell 870 can be configured such that the signal level in zone 904 is indicative of a certain selected weight and the signal level in zone 906 is indicative of another certain selected weight.

Figure 10:
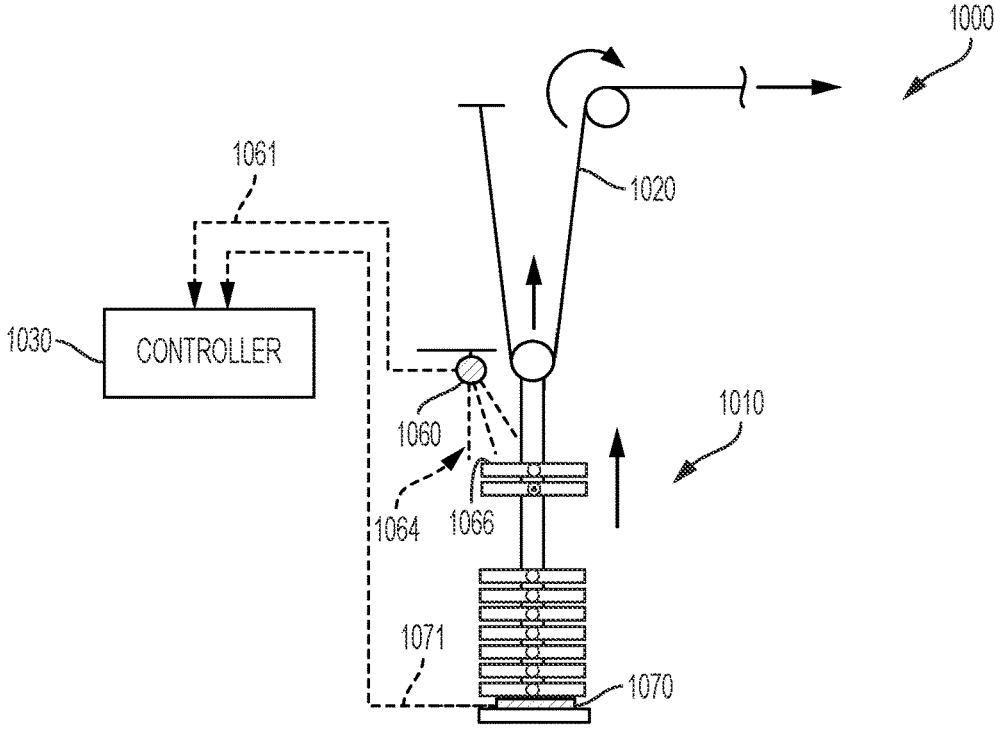
FIGS. 10-12 schematically depict example exercise apparatuses in accordance with varying embodiments.

Referring now to FIG. 10, an example exercise apparatus 1000 is depicted, the exercise apparatus 1000 being similar to, or the same as in many respects as, the exercise apparatus 600 illustrated in FIG. 6. For example, the exercise apparatus 1000 has a resistance assembly 1010 that is associated with a sensor 1070. The sensor 1070 provides signaling to a controller 1030 via communication coupling 1071. The exercise apparatus 1000 also has a flexible member 1020 that is coupled to the resistance assembly 1010. In this configuration, the movement of the resistance assembly 1010 during an exercise is tracked by a sensor 1060, with signaling provided to the controller 1030 via communication coupling 1031. The sensor 1060 can be, for instance, an optical sensor that transmits a beacon 1064 that is reflected off a portion of the resistance assembly 1010, such as a reflector on a surface 1066. Using the data extrapolated from the reflected beacon, the relative distance between the sensor 1060 and the surface 1066 can be determined. Thus, the controller 1030 can use information from collected by the sensor 1060 to determine the linear motion of the flexible member 1020 during an exercise.

Figure 11:
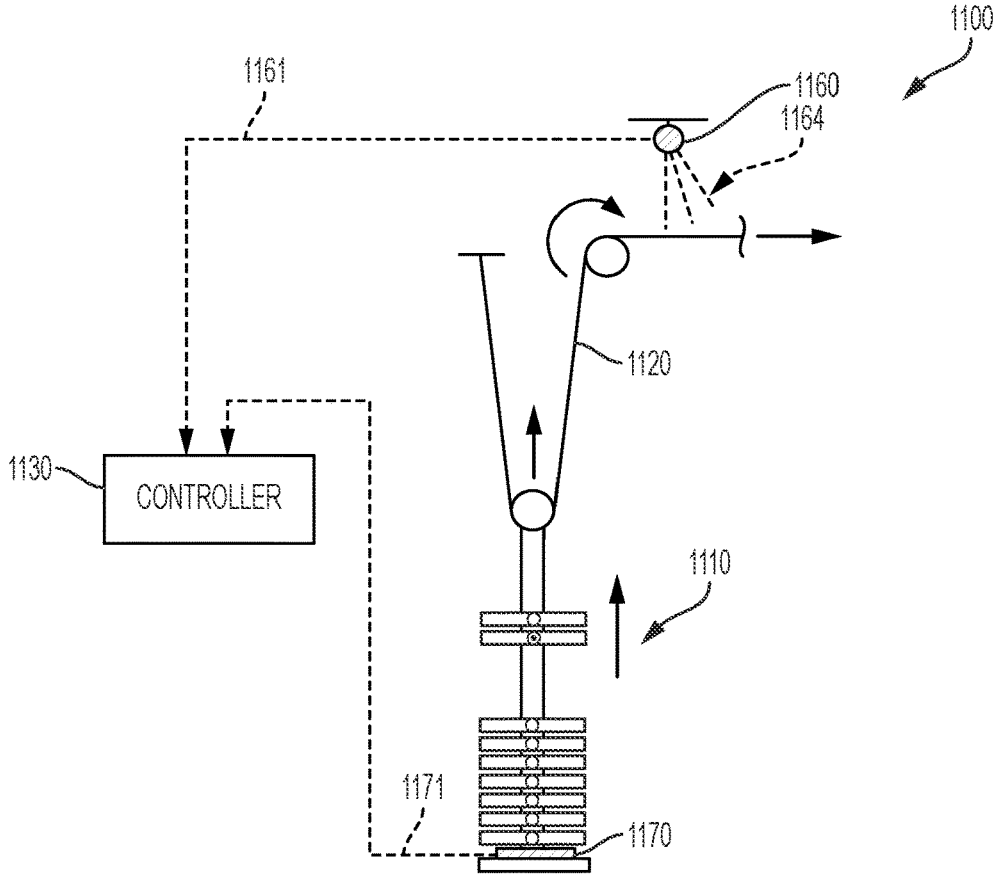

Referring now to FIG. 11, an example exercise apparatus 1100 is depicted, the exercise apparatus 1100 being similar to, or the same as in many respects as, the exercise apparatus 1000 illustrated in FIG. 10. The exercise apparatus 1100 has a resistance assembly 1110 that is associated with a sensor 1170. The sensor 1170 provides signaling to a controller 1130 via communication coupling 1171. The exercise apparatus 1100 also has a flexible member 1120 that is coupled to the resistance assembly 1110. In this configuration, the motion of the flexible member 1120 is tracked by a sensor 1160, with signaling provided to the controller 1130 via communication coupling 1131. The sensor 1160 is an optical sensor, which is positioned proximate to the flexible member 1120, such that motion of the flexible member 1120 can be optically tracked. For instance, the flexible member 1120 can have graphical indicia that are tracked by the sensor 1160 when they are within the optical detection zone 1164. Based on the graphical indicia, the controller 1130 can determine speed, distance traveled, and in some cases, direction of travel.

Figure 12:
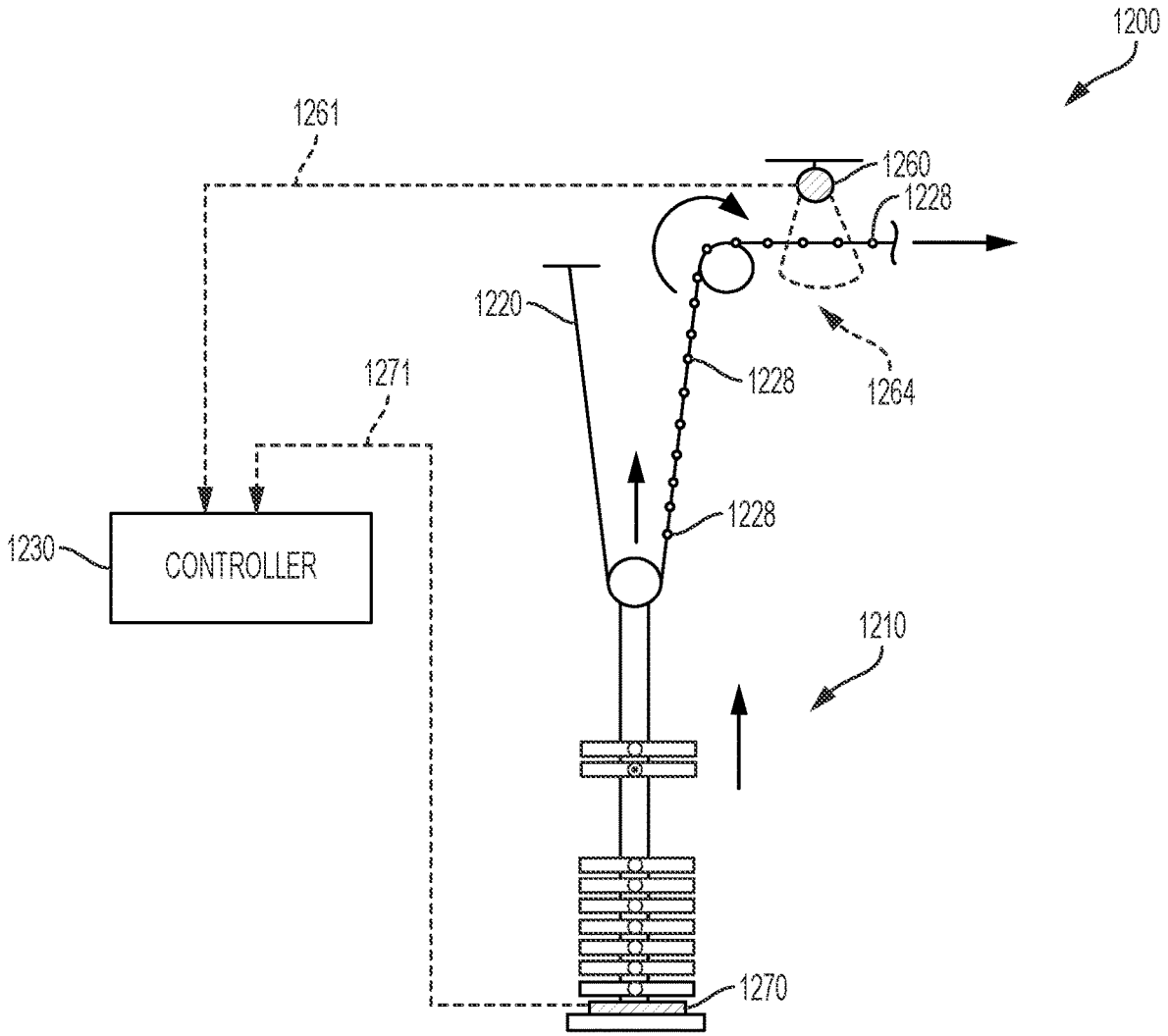

Referring now to FIG. 12, an example exercise apparatus 1200 is depicted, the exercise apparatus 1200 being similar to, or the same as in many respects as, the exercise apparatus 1100 illustrated in FIG. 11. The exercise apparatus 1200 has a resistance assembly 1210 that is associated with a sensor 1270. The sensor 1270 provides signaling to a controller 1230 via communication coupling 1271. The exercise apparatus 1200 also has a flexible member 1220 that is coupled to the resistance assembly 1210. In this configuration, the motion of the flexible member 1220 comprises a plurality of tags 1228 that are linearly spaced along a length of the flexible member 1220. In some embodiments, the tags 1228 are RFID tags that are embedded into the flexible member 1220, although this disclosure is not so limited. A sensor 1260, with signaling provided to the controller 1230 via communication coupling 1231, is positioned proximate to the flexible member 1220. Tags 1228 with a tag detection zone 1164 can be detected by the sensor 1264, such that motion of the flexible member 1120 can be tracked as the tags 1228 sequentially pass by the sensor 1260 during movement of the flexible member 1220. In some embodiments, the tags 1228 can each have a unique signature, such that the controller 1230 can determine which direction the flexible member 1220 is moving, and which portion of the flexible member 1220 is within the tag detection zone 1164, based on the signature of the tag(s) within the tag detection zone 1164.

It may be desirous to modify existing (i.e., "stock") exercise apparatuses such that exercise data generated from use of the exercise apparatus can be collected and transmitted. Such existing apparatuses may be located in, for example, a fitness center, a rehabilitation center, a hospital, a senior care facility, a home gym, among a wide variety of types of locations. In some cases, a particular site may have a plurality of different types of exercise apparatuses, which are each designed to focus on a particular muscle group, for example. In accordance with the present disclosure, one or more sensor devices can be coupled to one or more of the existing exercises apparatuses that are located at a particular site. The sensor device can include one or more onboard sensors that are configured to collect data responsive to exercises performed using the exercise apparatus such that exercise data is generated. The sensor device can also include onboard communication technology to wirelessly relay the exercise data to a receiver, such as a controller associated with a tablet computer, a client device, or other suitable computing device, system, or platform. Such communication technology can utilize any suitable wireless transmission protocol, such as Bluetooth, Ant+, WiFi, or cellular, among others.

Figure 13:
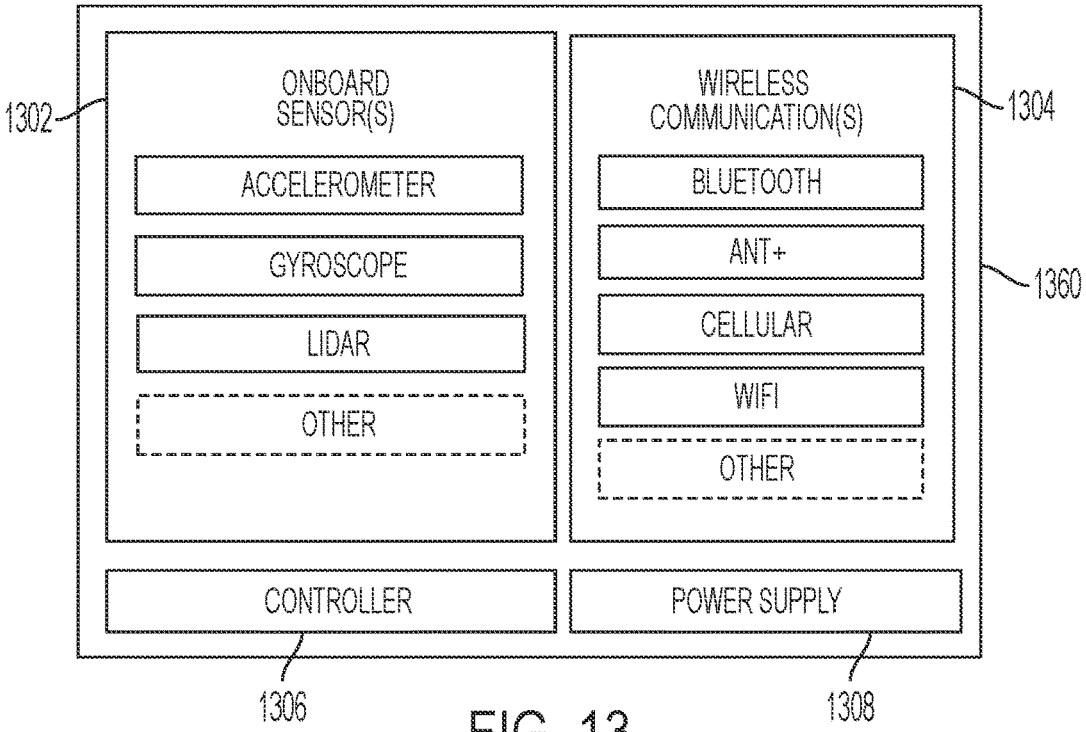
FIG. 13 is a block diagram of an example sensor device in accordance with one non-limiting embodiment.

Referring now to FIG. 13, a block diagram of an example sensor device 1360 is illustrated. Such sensor device 1360 can be selectively mounted to an exercise apparatus, as described in more detail below. The sensor device 1360 can include one or more onboard sensors 1302, such as, for example, an accelerometer, a gyroscope, a LiDAR sensor, among other types of sensor that are usable to monitor and track movement, strain, rotation, distance, and so forth. The sensor device 1360 can also include one or more wireless communication technologies 1304, as Bluetooth, Ant+, cellular, WiFi, among other suitable types of technologies. The sensor device 1360 can also include a power supply 1308, which can be, for example, a rechargeable and/or replaceable battery or power pack. The sensor device 1360 can also include a controller 1306 that is operatively connected to the onboard sensors 1302, the wireless communication technologies 1304, and the power supply 1308.

Figure 14:
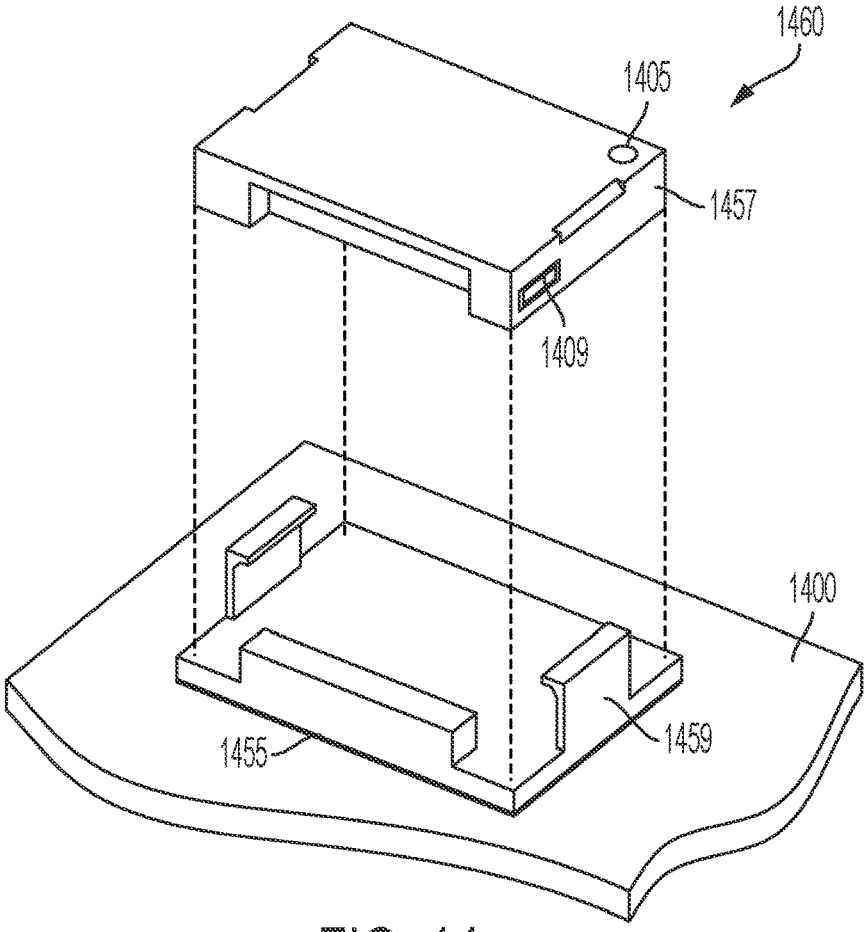
FIG. 14 is an isometric view of an example sensor device that can be selectively coupled to a surface of an exercise apparatus via an example mounting clip.

FIG. 14 is an isometric view of an example sensor device 1460 that can be selectively coupled to a surface of an exercise apparatus 1400 via a mounting clip 1459. The surface of the exercise apparatus 1400 can move, rotate, or otherwise translate, when a user of the exercise apparatus 1400 performs exercise movements. In this example embodiment, the mounting clip 1459 is coupled to the exercise apparatus 1400 using an adhesive 1455, although other embodiments can use other suitable connection or bonding means, such as hook and loop fasteners, double sided tape, and so forth. At the time of mounting, a particular angular relationship of the mounting clip 1459 to the exercise apparatus 1400 can be established in order to maintain the proper orientation of the sensor device 1460 when it is detached and re-attached, for example. For example, the mounting clip 1459 can be positioned such that when the sensor device 1460 is installed into the mounting clip 1459, the sensor device 1460 has a particular orientation relative to the exercise apparatus 1400. In this regard, a housing 1457 of the sensor device 1460 can be structured to connect to the mounting clip 1459 in a particular orientation to ensure proper attachment.

Figure 22A:
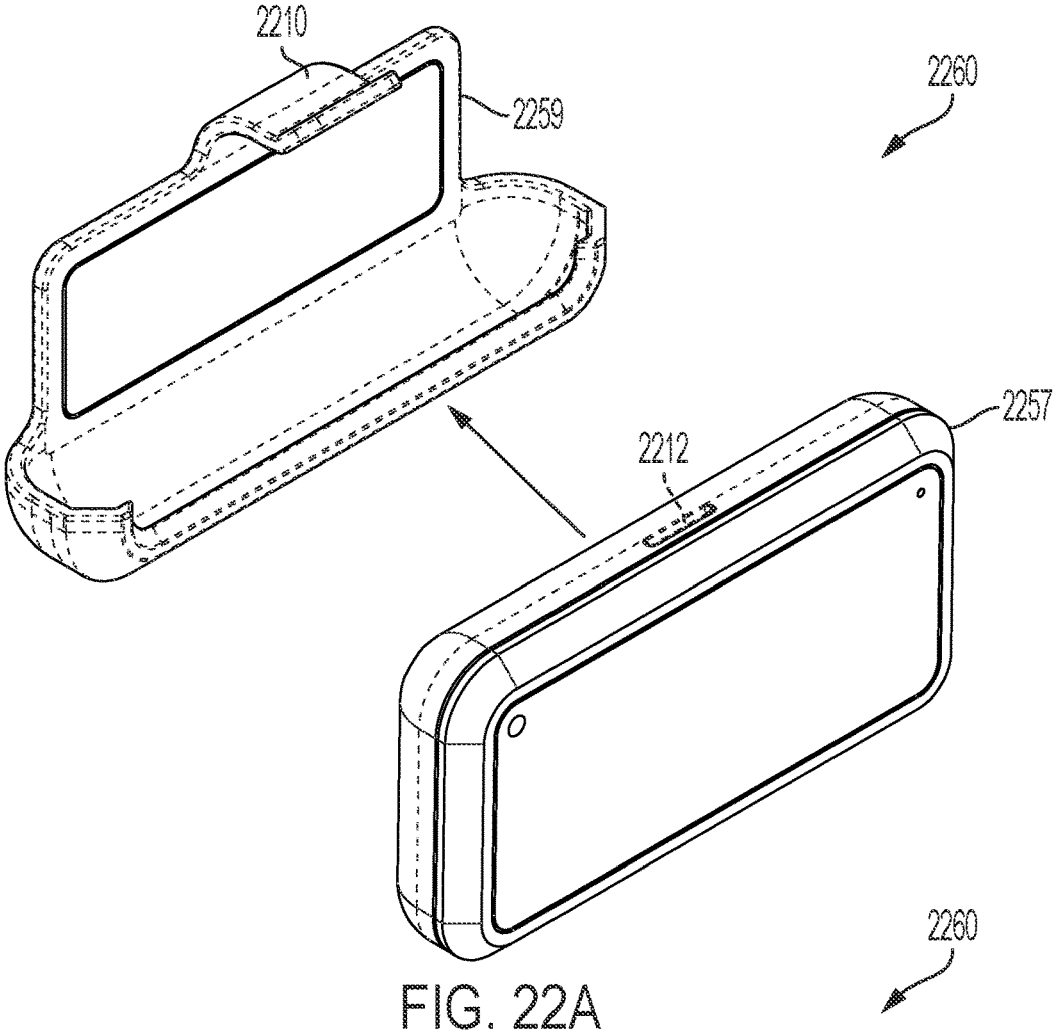
FIGS. 22A-22B depict another example sensor device in accordance with one non-limiting embodiment.
Figure 22B:
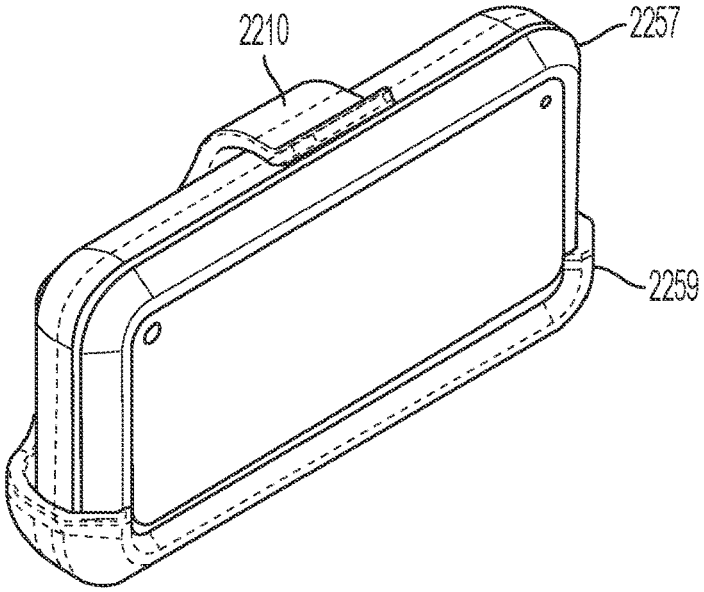

While the housing 1457 is shown in FIG. 14 as being generally rectangular, this disclosure is not so limited. It is to be understand that the housing 1457 can have any suitable form factor, such as puck-shaped, cube-shaped, pill-shaped, among others. The housing 1457 can also have a port 1409 that can be used for charging the power supply 1308 (FIG. 13), for example. An indicator 1405, such as a light emitting device, audible device, or other type of indicator, can also be provided on the sensor device 1460. Such indicator 1405 can be used to indicate, for example, low battery, connectivity issues, operational modes, and so forth. FIGS. 22A-22B depict another example sensor device 2260 having a housing 2257 and a mounting clip 2259 in accordance with one non-limiting embodiment. The mounting clip 2259 is configured to receive and selectively hold the housing 2257. The mounting clip 2259 can include, for example, a latch 2210 that is configured to apply force to a detent 2212 of the housing 2257 to maintain proper coupling of the housing 2257 to the mounting clip 2259. In the example embodiment, the latch 2210 can be slightly flexed away from the detent 2212 by a user when the housing 2257 needs to be removed from the mounting clip 2259. As provided above, the mounting clip 2259 can be secured to an exercise apparatus through any suitable technique, such as an adhesive, hook-and-loop fastener, magnets, among others.

Figure 15A:
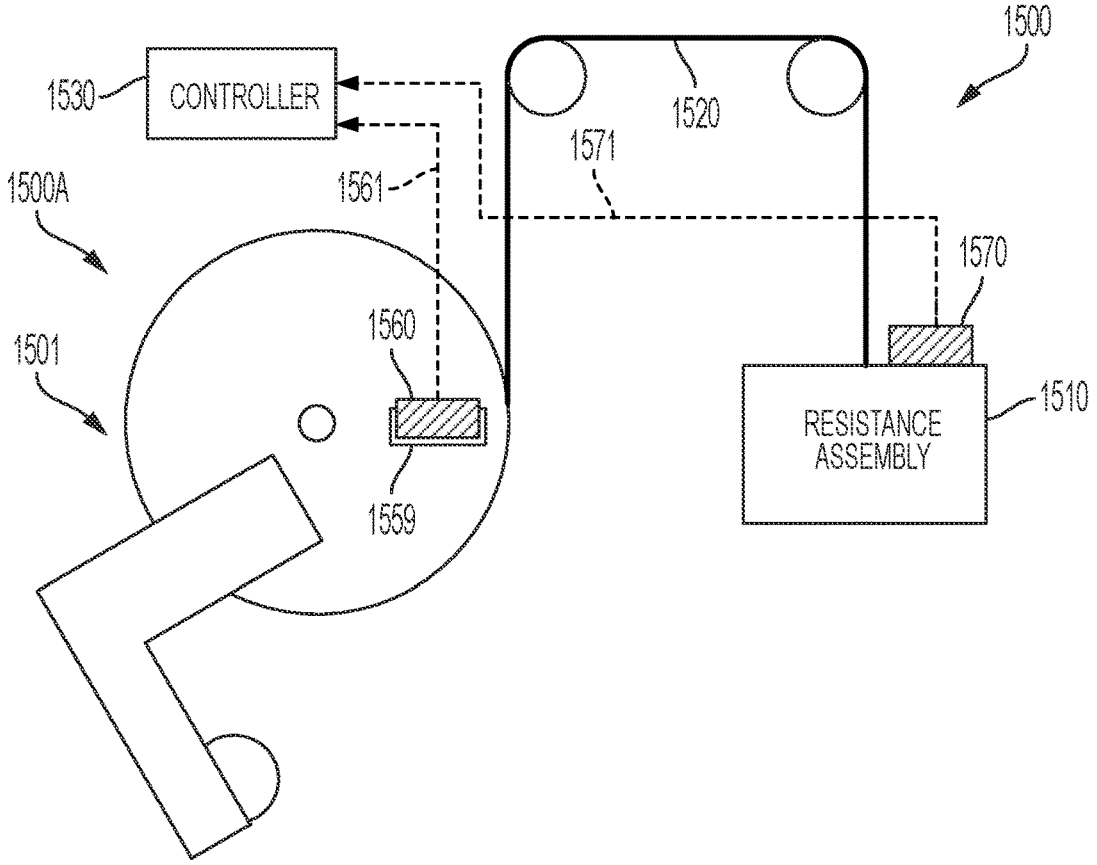
FIGS. 15A-15B depict an exercise apparatus in an initial position (FIG. 15A) and an engaged position (FIG. 15B).
Figure 15B:
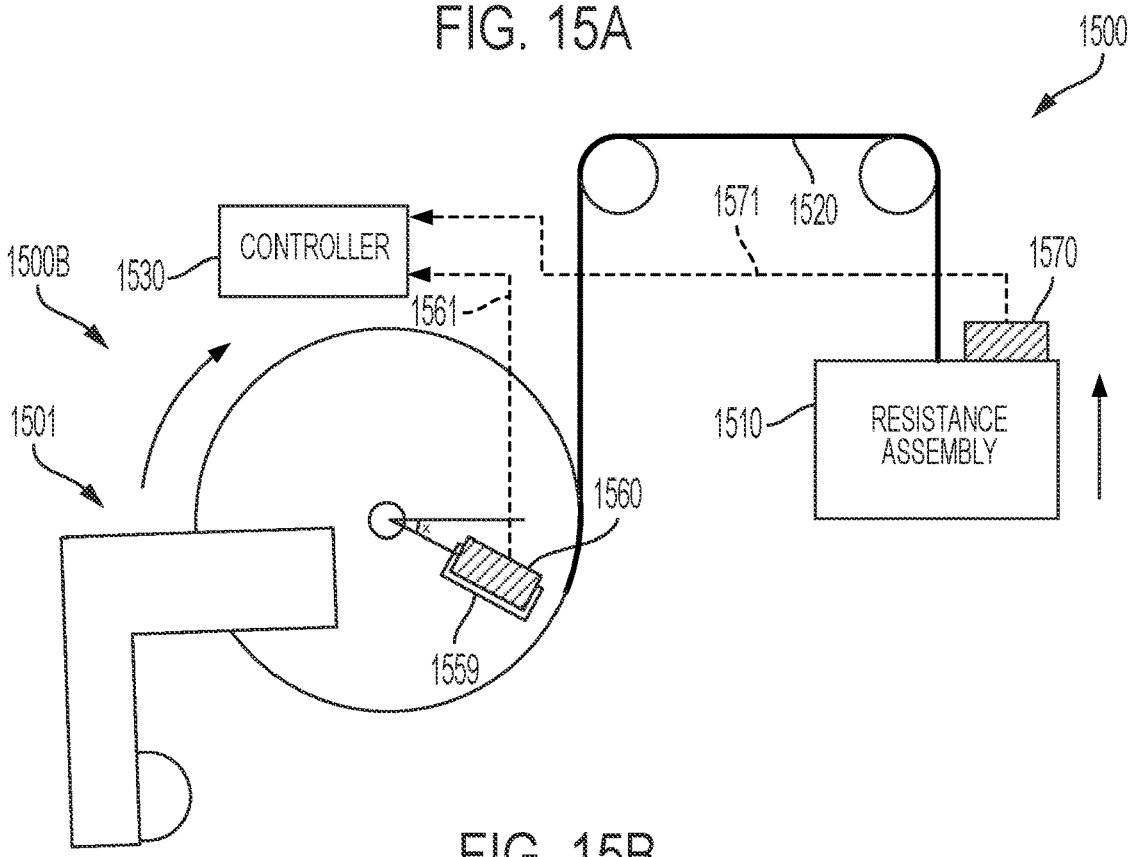

Referring now to FIGS. 15A-15B an exercise apparatus 1500 is schematically illustrated in an initial position 1500A (FIG. 15A) and an engaged position 1500B (FIG. 15B). The exercise apparatus 1500 has an interaction member 1501 that is operatively connected to a flexible member 1520 and is configured to be rotated about an axis by a user of the exercise apparatus 1500. The flexible member 1520 is also operatively connected to a resistance assembly 1510 such that the resistance assembly 1510 functions to resist the angular rotation of the interaction member 1501. While the exercise apparatus 1500 includes an interaction member 1501 that rotates, it is to be readily appreciated that other types of exercise apparatuses may have interaction members that translate, pivot, slide, or otherwise are moved by a user of the exercise apparatus.

In these illustrated example embodiments, a first sensor device 1560 is coupled to the interaction member 1501. The first sensor device 1560 can be similar to the sensor device 1360 of FIG. 13. The first sensor device 1560 can be coupled directly to the interactive member 1501, such as via hook and loop fasteners, magnets, or adhesive, for example. In the illustrated example shown in FIGS. 15A-15B, the first sensor device 1560 is engaged to the interaction member 1501 via a mounting clip 1559. The mounting clip 1559 can be attached to the interaction member 1501 such that when the first sensor device 1560 is installed into the mounting clip 1559, the first sensor device 1560 has a particular orientation when the exercise apparatus is in the initial position 1500A. In this way, if the first sensor device 1560 is removed from the mounting clip 1559, such as during charging, the first sensor device 1560 can be re-mounted to the interaction member 1501 in the proper orientation and any calibration of the first sensor device 1560 that was previously performed will still be accurate.

Using data from its onboard sensors, the first sensor device 1560 can be configured to detect and track movement of the interaction member 1501 in order to track exercise data. For example, the first sensor device 1560 can be calibrated such that angular rotation of X degrees (FIG. 15B) constitutes one "rep" when a user is exercising with the exercise apparatus 1500. Accordingly, each angle between 0 degrees and X degrees can be correlated to provide feedback over the entire range of motion for the exercise apparatus 1500. In the example embodiment illustrated in FIGS. 15A-15B, a second sensor device 1570 is shown attached to the exercise apparatus 1500. In particular, the second sensor device 1570 is associated with the resistance assembly 1510 such that the amount of weight selected by the user can be detected.

The first and second sensor devices 1560 and 1570 are shown to be in wireless communication with a controller 1530 through communication couplings 1561 and 1571. The controller 1530 can be configured with a profile for the exercise apparatus 1500 so that proper exercise tracking can be performed. For example, the controller 1530 can be configured to interpret the signals received from the first and second sensors 1560 and 1570 to convert the signals into quantified exercise data, such as weight amount, number of repetitions, number of sets, stroke distance, stroke speed, etc. It is noted that such quantified exercise data can be based on a calibration of the first and second sensor devices 1560 and 1570. For instance, during an initial set-up, a routine can be performed in which a user calibrates the first and second sensor devices 1560 and 1570 to determine the stroke of particular movements, the maximum and minimum weight amounts, and so forth. In some embodiments, a user executing the routine can select a make/model of the exercise apparatus 1500 to receive a pre-determined list of data points that are to be collected to calibrate the machine. In other embodiment, a user can execute a custom routine to calibrate the machine. In any event, subsequent to calibration, the data collected by the one or more sensors of first and second sensor devices 1560 and 1570 can be used to generate quantified exercise data.

Figure 16:
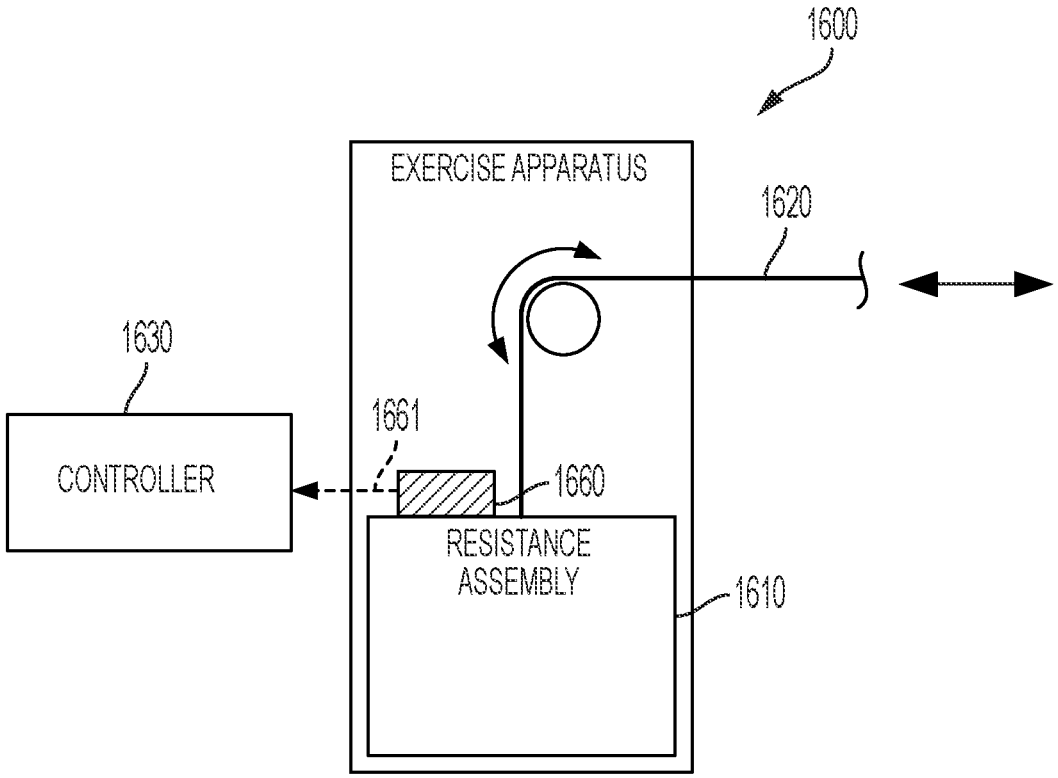
FIGS. 16-18 schematically depict simplified exercise apparatuses that have been augmented with sensor devices.
Figure 17:
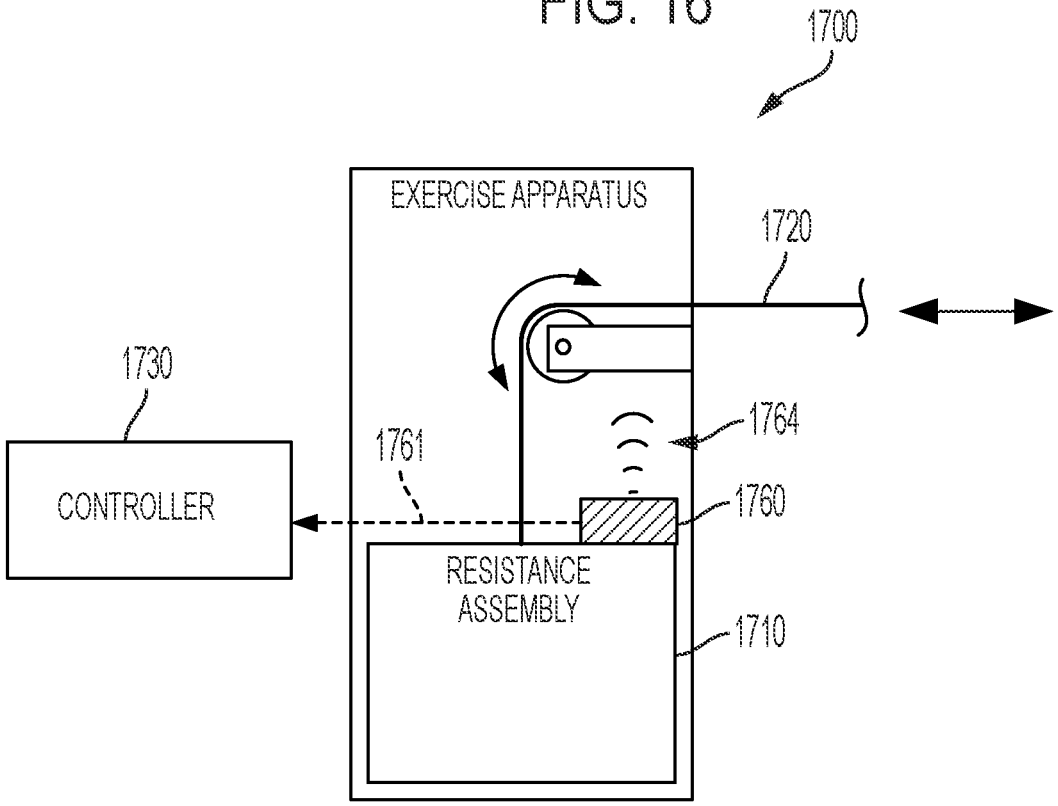
Figure 18:
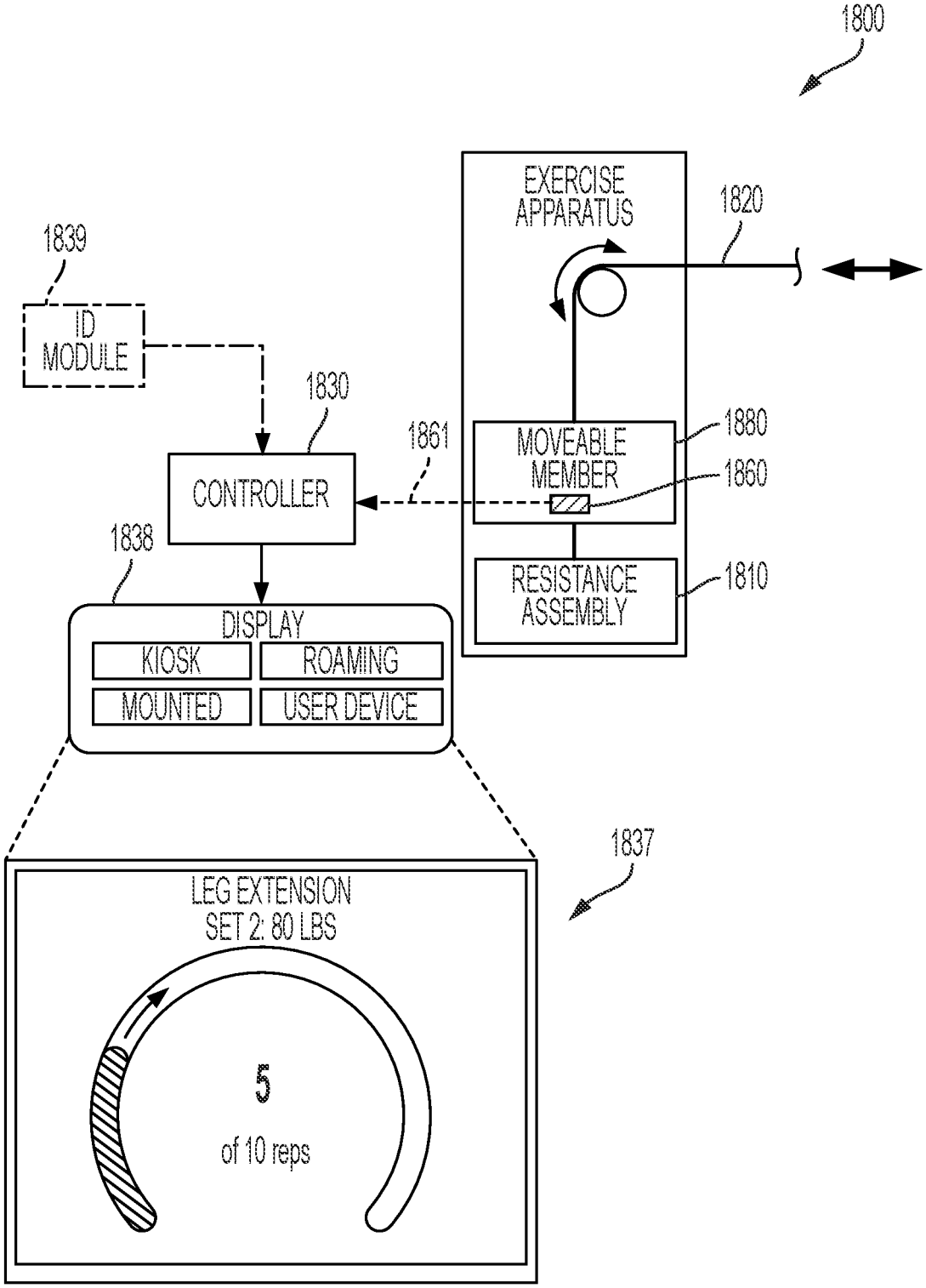

It is to be appreciated, that any of a wide variety of different types of cardio training exercise apparatuses and strength training exercise apparatuses can be augmented with one or more sensor devices in accordance with the present disclosure. FIGS. 16-18 schematically depict simplified exercise apparatuses that have been augmented with sensor devices. Referring first to FIG. 16, an exercise apparatus 1600 is illustrated. In this embodiment, the exercise apparatus 1600 has a resistance assembly 1610 that is connected to a flexible member 1620. In this embodiment, a sensor device 1660 is associated with a resistance assembly 1610 and is in communication with a controller 1630 via a communication coupling 1661. Based on its onboard sensors, the sensor device 1660 can be used to collect information regarding the resistance assembly 1610, such as, for example, distance of travel, direction of travel, speed of travel, amount of weight lifted, and so forth. Such information can be fed to the controller 1630, which can determine quantified exercise data to monitor and log the workout of a user.

Referring next to FIG. 17 another example exercise apparatus 1700 is illustrated. In this embodiment, the exercise apparatus 1700 has a resistance assembly 1710 that is connected to a flexible member 1720. In this embodiment, a sensor device 1760 is coupled to the resistance assembly 1710 and is in communication with a controller 1730 via a communication coupling 1761. Based on its onboard sensors, the sensor device 1760 can be used to collect information regarding the resistance assembly 1710. In this particular embodiment, an optical sensor of the sensor device 1760 transmits a beacon 1764 that is reflected off a portion of the exercise apparatus 1700 which can be used to determine, for example, distance of travel, direction of travel, speed of travel, and so forth. Additional information can also be collected from other onboard sensors, such as a gyroscope, accelerometer, and/or other sensors. Such information can be fed to the controller 1730, which can determine quantified exercise data to monitor and log the workout of a user.

Referring now to FIG. 18, another example exercise apparatus 1800 is illustrated. In this embodiment, the exercise apparatus 1800 has a resistance assembly 1810 that is connected to a flexible member 1820 via a moveable member 1860. The configuration of the moveable member 1860 will vary based on the type of exercise apparatus 1800. In this example embodiment, a sensor device 1860 is coupled to the movable member 1880 and is in communication with a controller 1830 via a communication coupling 1861. Based on its onboard sensors, the sensor device 1860 can be used to collect information regarding the moveable member 1880, such as, for example, rotation, distance of travel, direction of travel, speed of travel, amount of weight lifted, and so forth. Such information can be fed to the controller 1830, which can determine quantified exercise data to monitor and log the workout of a user. As shown in FIG. 18, in some embodiments an identification module 1839 can be utilized to assist with tracking the user of the exercise apparatus 1800. Similar to the identification module 639 in FIG. 6, the identification module 1839 can receive identifying data from the user, sometimes referred to as user indicia. The identification module 1839 can include, for example, a non-contacting sensor and a wireless communication identification module. For example, when a user approaches the exercise apparatus 1800 the non-contacting sensor can generate a signal instructing the wireless communication identification module to transmit a polling signal. In some embodiments the wireless communication identification module comprises any of a radio frequency identifier (RFID) module, an 802.11 wireless module, a Bluetooth module, or combinations thereof. Once user identifying information has been received by the controller 1830, a user indicia message can be provided to a display 1838. The display 1838 can be provided by any suitable device, such as, for example, a computing device in a kiosk positioned proximate to the exercise apparatus 1800, a computing device mounted directly to the exercise apparatus 1800, a handheld computing device that a user can carry from exercise apparatus to exercise apparatus, and/or a user's client device. In some embodiments, the identification module 1839 is a component of the computing device. Based on the user, various instructions can be provided to the user via the display 1838, such as configuration instructions. Once exercise has commenced, based on signals generated by the sensor device 1860, exercise data can be wirelessly provided to the controller 1830. Subsequent to a user exercising, or in substantially real-time, one or more messages comprising exercise event data 1837 can be displayed on the display 1838. Exercise event data 1837 can include configuration information, number of sets, number of repetition, range of motion, and so forth. Thus, a user of the exercise device 1800 can receive real-time visual feedback regarding the exercise based on data collected by the sensors of the sensor device 1860.

Figure 19:
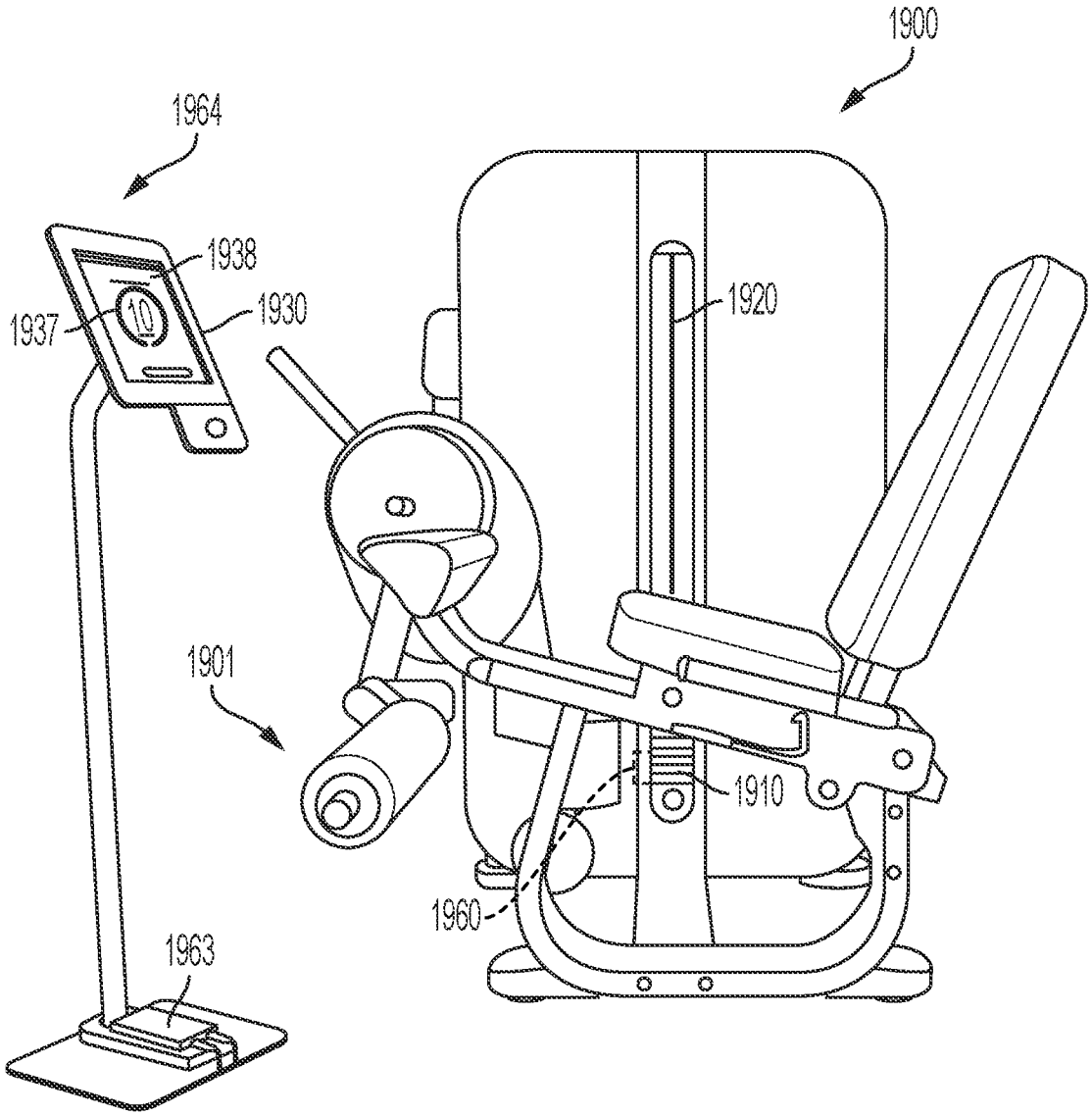
FIG. 19 depicts an example exercise apparatus.

FIG. 19 depicts an example exercise apparatus 1900 having a resistance assembly 1910 operatively coupled to a flexible member 1920 and an interaction member 1901. This example exercise apparatus 1900 is configured as a leg extension machine. A sensor device 1960 is associated with the resistance assembly 1910 that is configured to generate data that indicates direction of travel, speed of travel, distance of travel, and amount of weight selected on the resistance assembly 1910. Other sensors may also be coupled to various structures of the exercise apparatus 1900. Information from the sensor(s) 1960 can be transmitted wirelessly to a controller 1930, which is shown as a component of a tablet computer mounted to a kiosk 1964. The example kiosk 1964 include a rechargeable battery pack 1963 for powering the tablet computer. A display 1938 can be used to convey exercise event data 1937, such as the number of reps completed, the number of sets completed, among other information. Further, in some embodiments, the display 1938 can be used to supply configuration information to the user. For instance, once the user is identified by an identification module (not shown), the display 1938 can provide instructions to the user, such as an amount of weight to be lifted, a number of repetitions to be completed, a number of sets to be completed, and so forth. As the user completes the exercises on the exercise apparatus 1900, exercise event data can be collected and associated with a user profile of the user.

A visual representation of workout information can also be presented on the display 1938 in real-time, based on data collected by the sensor device 1960. In this regard, a repetition (e.g., a "rep") count can be incremented on the display 1938 as the user completes strokes of the exercise apparatus 1900. Additionally, the stroke can be visually presented as an animated icon, such that as the user moves the interaction member 1901, the icon animates to represent the stroke. The stroke length can be based on a calibration of the sensor device 1960. For example, during calibration it may be determined that a full stroke is 12 inches of vertical travel by the sensor device 1960. Thus, once the sensor device 1960 is vertically moved 12 inches during a workout, a rep will be counted. Additionally, vertical travel between 0 and 12 inches can be correlated to the stroke, such that a percentage of stroke completion can be graphically conveyed to the user on the display 1938. By way of example, if the user has raised the sensor device 1960 six inches via the interaction member 1901, the icon can graphically indicate in real-time that the stroke is halfway completed.

Figure 20:
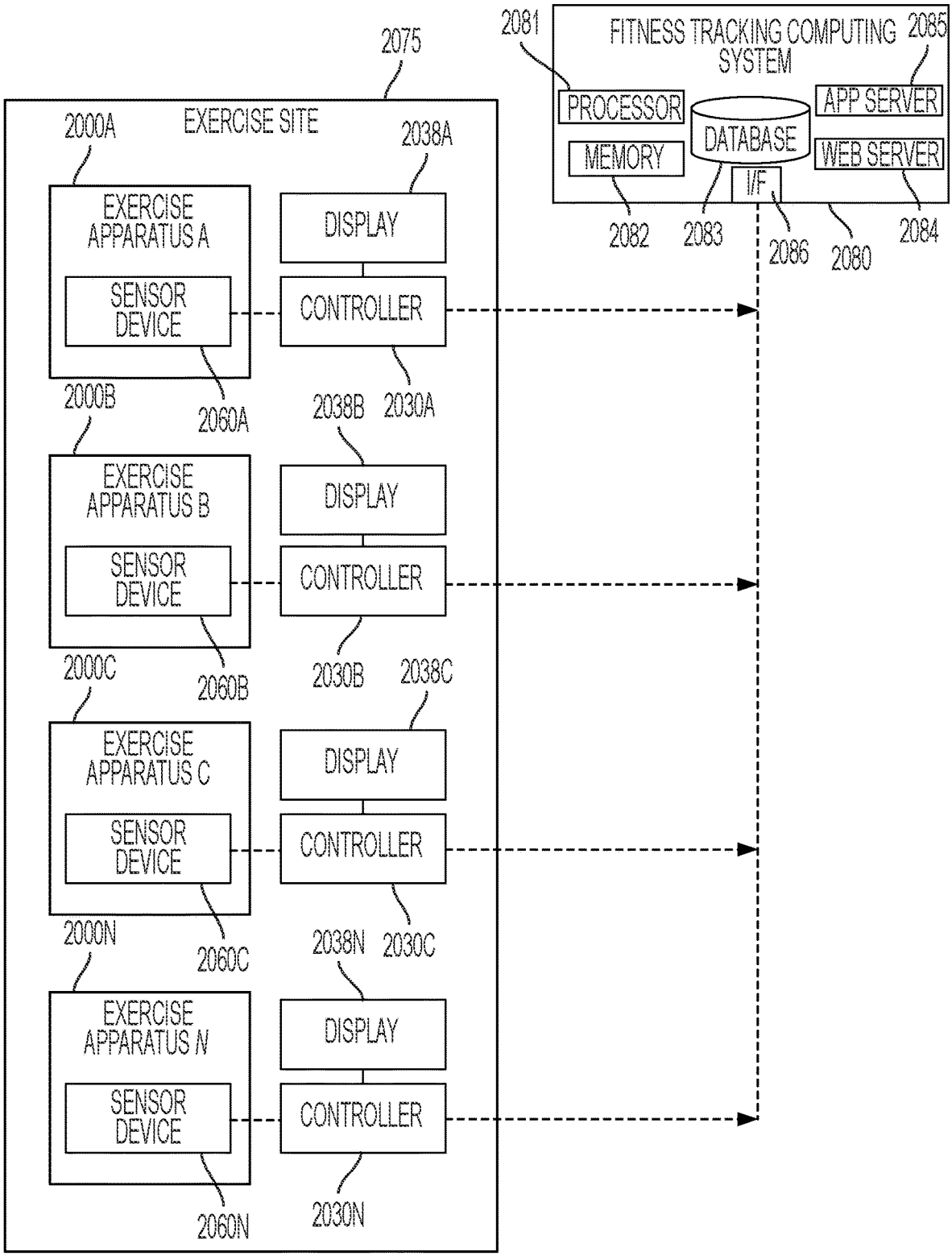
FIG. 20 schematically depicts an example fitness tracking computing system and an exercise site in accordance with one non-limiting embodiment.

Stock exercise apparatuses that are augmented with one or more sensor devices in accordance with the present disclosure can allow for recordation of exercises that are completed on the equipment. Exercise data collected by the sensor devices can be collected, transmitted and stored in an associated fitness tracking computing system. FIG. 20 schematically depicts an example fitness tracking computing system 2080 in accordance with one non-limiting embodiment. In accordance with various embodiments, the fitness tracking computing system 2080 can be HIPPA compliant and be cloud-based. Data analytics systems can be provided by a fitness tracking computing system 2080 that stores both individual and aggregate user data for monitoring, analytics, export, reporting and numerous other purposes.

As shown, the fitness tracking computing system 2080 can be in communication with a plurality of exercise apparatuses 2000A-N via respective controllers 2030A-N. Some example metrics that can be captured by fitness tracking computing system 2080 based on sensor devices 2060A-N can include time, calories, and repetitions. Various exercise data collected from the sensor devices 2060A-N can be transmitted to the fitness tracking computing system 2080 from each exercise apparatus 2000A-N. Interactions with the exercise apparatuses 2000A-N by users can be captured and uploaded to the fitness tracking computing system 2080; which can then be accessible for analysis and reconfiguration to physicians, therapists, care-givers, service providers and individual users through any internet enabled device. As is to be appreciated, using the data collection techniques described herein, manual tracking and recording by a therapist or other service provider and then manually re-entering the data into an electronic medical records system (EMR) is reduced or eliminated. Furthermore, users, patients, doctors, and therapists, among other types of users, can create rehabilitation and fitness routines and then track, monitor, reconfigure and oversee the outcomes and progress from these routines from anywhere via the Internet, for example.

In accordance with various embodiments, a library of exercises and workouts can be stored by the fitness tracking computing system 2080 and assigned to patients, clients and users. These libraries can be filterable by muscle group and offer customization for therapists and other types of users. In some embodiments, the exercises and workouts can be automatically modified to adapt to the particular exercise apparatuses 2000A-N at a particular exercise site 2075. By way of example, a particular routine for a user may require the use of a squat machine for leg training. However, the user may be at exercise site 2075 that does not have a squat machine. Based on the profile of exercise apparatuses 2000A-N at the exercise site 2075, the fitness tracking computing system 2080 can therefore direct the user to one of the exercise apparatuses 2000A-N that can serve as a replacement (i.e., a leg extension machine). Thus, the fitness tracking computing system 2080 can allow the user to complete their pre-defined routine or workout based on the particular exercise apparatuses 2000A-N available at the exercise site 2075 through adaptive modification of the routine based on site-specific equipment availability.

Additionally, various types of user accounts can be created and maintained by a fitness tracking computing system 2080. In one embodiment, the account types include business accounts, professional accounts, and personal accounts. Business accounts can be for facilities and generally enable the management of multiple professionals and clients such as hospitals, rehabilitation facilities, nursing homes, etc. Numerous administrative tools can be provided to these accounts. Professional accounts can be for practitioners (for example, physicians, therapists, personal trainers and coaches) to manage multiple patient and client accounts. Personal accounts can be for individual users and can be used independently or with an associated professional.

The fitness tracking computing system 2080 can be in communication with the controllers 2030A-N associated with the exercise apparatuses 2000A-N over one or more networks, including both wireless and wireline communication networks. The fitness tracking computing system 2080 can be provided using any suitable processor-based device or system, such as a personal computer, laptop, server, mainframe, mobile computer, other processor-based device, or a collection (e.g. network) of multiple computers, for example. The fitness tracking computing system 2080 can include one or more processors and one or more memory units. For convenience, only one processor 2081 and only one memory unit 2082 are shown in FIG. 20. The processor 2081 can execute software instructions stored on the memory unit 2082. The processor 2081 can be implemented as an integrated circuit (IC) having one or multiple cores. The memory unit 2082 can include volatile and/or non-volatile memory units. Volatile memory units can include random access memory (RAM), for example. Non-volatile memory units can include read-only memory (ROM) as well as mechanical non-volatile memory systems, such as a hard disk drive, optical disk drive, or other non-volatile memory. The RAM and/or ROM memory units can be implemented as discrete memory ICs.

The memory unit 2082 can store executable software and data. When the processor 2081 of the fitness tracking computing system 2080 executes the software instructions of various modules, the processor 2081 can be caused to perform the various operations of the fitness tracking computing system 2080. The various operations of the fitness tracking computing system 2080 can include communicating with the exercise apparatuses 2000A-N, transmitting data to the exercise apparatuses 2000A-N, receiving data from the exercise apparatus 2000A-N, receiving data from a third party computing system, transmitting data to a third party computing system, as well as providing various types of graphical interfaces and portals for accessing and managing data stored or processed by the fitness tracking computing system 2080.

The fitness tracking computing system 2080 can store and access data in a variety of databases 2083. The data stored in the databases 2083 can be stored in a non-volatile computer memory, such as a hard disk drive, read only memory (e.g. a ROM IC), or other types of non-volatile memory. In some embodiments, one or more of the databases 2083 can be stored on a remote electronic computer system and can be accessed by the fitness tracking computing system 2080 via a network. At least some of the data stored in the databases 2083 can be stored in compliance with relevant privacy considerations. As one having ordinary skill in the art would appreciate, a variety of other databases or other types of memory storage structures can be utilized or otherwise associated with the fitness tracking computing system 2080.

Also shown in FIG. 20, the fitness tracking computing system 2080 can include one or more computer servers, which can include one or more web servers, one or more application servers, and/or other types of servers. For convenience, only one web server 2084 and one application server 2085 are depicted in FIG. 20, although one having ordinary skill in the art would appreciate that the disclosure is not so limited. The servers 2084, 2085 can cause content to be sent to the controllers 2030A-N of the exercise apparatuses 2000A-B for display on the displays 2038A-N, or other computing devices, via a network. The displays 2038A-N can be, for example, local to the exercise apparatuses 2000A-N, such as mounted thereto or positioned on a kiosk stationed near the apparatus. Additionally or alternatively, the displays 2038A-N can be provided by another device viewable by a user, such as a smart phone, tablet computer, or a laptop, for example, that is in communication with the fitness tracking computing system 2080. The displayed information can be, for example, a welcome screen, user information, exercise instructional data (text, graphics, audio, and/or video), an exercise status summary, a set count, a repetition count, an indication of resistance, as well as any other status or informational content (e.g., caloric data), as may be desirable.

In some embodiments, the web server 2084 can provide a graphical web user interface through which various users can interact with the fitness tracking computing system 2080. The graphical web user interface can also be referred to as a graphical user interface, client portal, client interface, graphical client interface, and so forth. The web server 2084 can accept requests, such as HTTP requests, from clients and serve the clients responses, such as HTTP responses, along with optional data content, such as web pages (e.g. HTML documents) and linked objects (such as images, video, documents, data, and so forth). The application server 2085 can provide a user interface for users who do not communicate with the fitness tracking computing system 2080 using a web browser. Such users can have special software installed on their computing device to allow the user to communicate with the application server 2085 via a network.

The fitness tracking computing system 2080 can be in communication with the exercise apparatuses 2000A-N via network connections using a suitable communications interface 2086. The network can be an electronic communications network and can include, but is not limited to, the Internet, LANs, WANs, GPRS networks, other networks, or combinations thereof. The network can include wired, wireless, fiber optic, other connections, or combinations thereof. In general, the network can be any combination of connections and protocols that will support communications between the fitness tracking computing system 2080 and the exercise apparatuses 2000A-N. Data communicated via the network can be of various formats and can include, for example, textual, visual, audio, written language, other formats or combinations thereof.

In accordance with some embodiments, a user can interact with user identification systems (not shown) upon approaching one of the exercise apparatuses 2000A-N (i.e., exercise apparatus 2000A). The user identification system can facilitate identification of the user based on user-provided information. Examples of user-provided information comprise, without limitation, data provided from a key or dongle (such as an RFID tag), biometric data, a coded input, and so forth. Upon receiving the user identification data, the user identification data can be provided to the fitness tracking computing system 2080 over the network by the controller 2030A of the exercise apparatuses 2000A. In some embodiments, a user's name is not provided through the network in order to mitigate privacy concerns. In addition to the user identification data, machine data from the exercise apparatus 2000A can also be provided to the fitness tracking computing system 2080. Upon receiving the user identification data, the fitness tracking computing system 2080 can access one or more records stored in a database 2083. The record in the database 2083 can indicate one or more exercise protocols for the user, as well has other fitness related data. The exercise protocol can comprise, for example, one or more exercises to be performed on the exercise apparatus exercise apparatus 2000A at a particular resistance level. The exercise protocol can then be transmitted by the fitness tracking computing system 2080 and received by the controller of the exercise apparatus. In some embodiments, the fitness tracking computing system 2080 can determine the last exercise performed by that user (either at that machine or a different machine) and ask the user if they wish to continue that workout regimen.

In any event, instructional content can be displayed on a visual display indicating, for example, an instruction for a first exercise. When a user performs the exercise, one or more exercise event signals are generated by one or more sensor devices 2060A. These exercise event signals can be received and processed by the controller 2030A. Using these signals, exercise data can be tracked and logged locally at the exercise apparatus 2000A and/or at the fitness tracking computing system 2080.

As a user is performing the exercise, the visual display 2038A can provide an exercise status summary that comprises, for example, set data, repetition data, repetition data, timing data, and/or other types of fitness-related data (such as caloric data and/or left arm vs. right arm data), and so forth. This data can be based on, for example, the signals received from the sensor devices 2060A and provided to the controller 2030A. Similar data can also be provided to the fitness tracking computing system 2080 so the exercise profile associated with that user can be updated. In some embodiments, when the user eventually walks away from the exercise apparatus 2000A, stops interacting with the apparatus, or expressly "logs out," the data collection for that exercise session will cease.

As is to be appreciated, a particular exercise site 2075 may house a large number of "stock" exercises apparatuses 2000A-N that are each configured to enable a user to perform a particular type of exercise. Additionally, a relatively large number of users may simultaneously be exercising at the exercise site 2075, with each user stepping through an exercise routine, as stored in the fitness tracking computing system 2080. In accordance with various embodiments, the fitness tracking computing system 2080 can direct individual users to particular exercise apparatus 2000A-N in order to manage and coordinate the use the of the exercise apparatus 2000A-N. In this regard, the fitness tracking computing system 2080 is aware of which of the exercise apparatus 2000A-N are occupied and which are being used. For occupied exercise apparatus 2000A-N, the fitness tracking computing system 2080 is aware if a user just began to complete a workout at the particular exercise apparatus or if the user is nearing completion. As such, upon a user completing a workout on one of the exercise apparatus 2000A-N, the fitness tracking computing system 2080 can specifically direct the user to another one of the exercise apparatus 2000A-N based on that user's workout routine and the current availability of the exercise apparatuses 2000A-N at the exercise site 2075. The direction can be provided to the user in any of a variety of suitable techniques. For example, instructions can be transmitted to a client device of the user that directs the user to a particular exercise apparatus 2000A-N. Additionally or alternatively, the display 2038A-N associated with that exercise apparatus can display the user's initials, or other indicia, to help guide the user to the proper apparatus. Thus, in accordance with various embodiments, the fitness tracking computing system 2080 can be used to facilitate adaptive sequencing based on real-time use of the various exercise apparatuses 2000A-N, to allow for efficient use of the exercise apparatuses 2000A-N at the exercise site 2075 for a multitude of simultaneous users.

Figure 21:
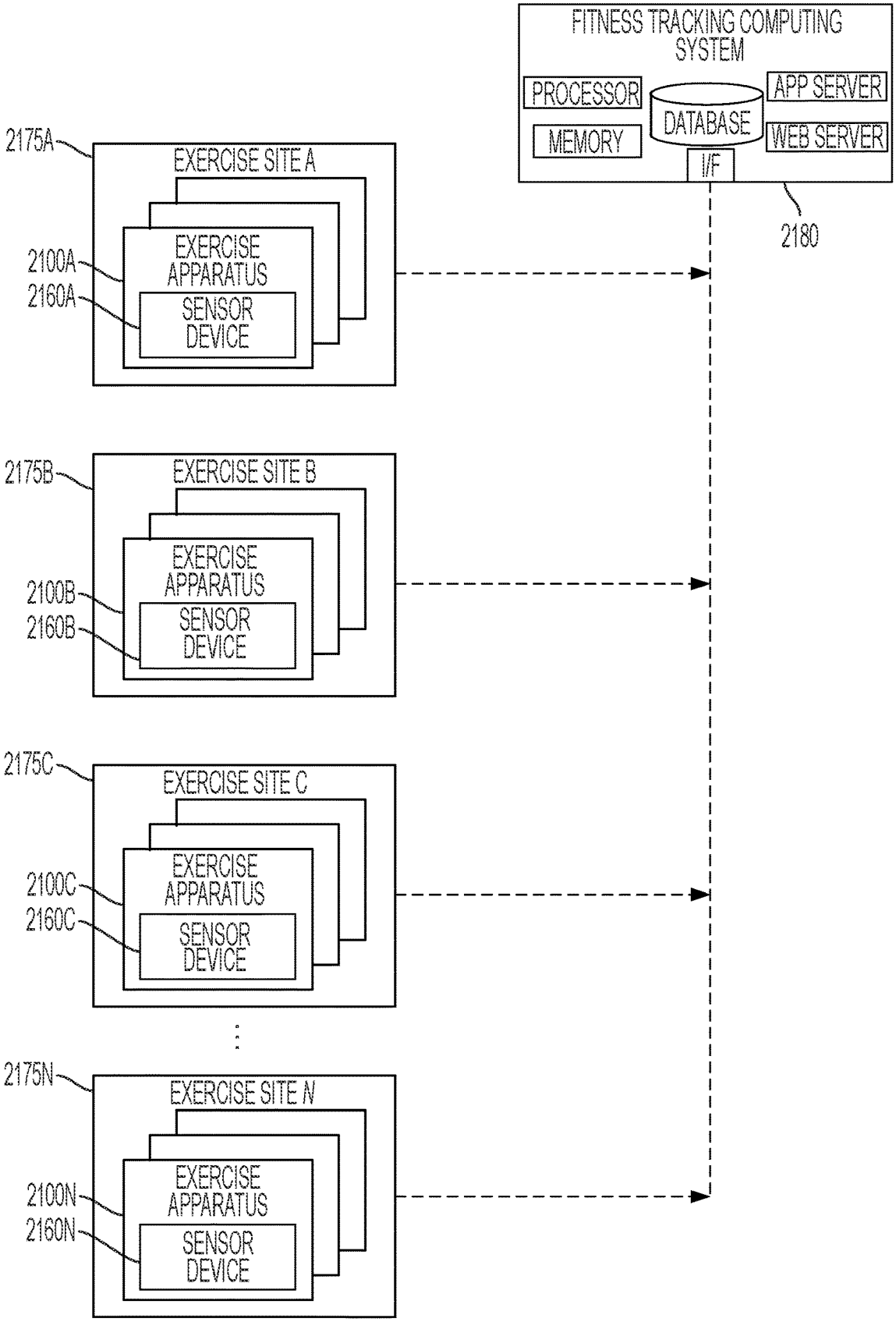
FIG. 21 schematically depicts an example fitness tracking computing system and a plurality of exercise sites in accordance with one non-limiting embodiment.

While FIG. 20 schematically depicts the fitness tracking computing system 2080 being affiliated with a single exercise site 2075, it is to be appreciated that the fitness tracking computing systems in accordance with the present disclosure can also be affiliated with multiple exercise sites, which each exercise site having a unique set of exercise apparatuses that allow specific types of workouts to be performed. It is to be appreciated that sites can have a wide variety of different types of cardio training exercise apparatuses and strength training exercise apparatuses, each of which can be augmented with one or more sensor devices in accordance with the present disclosure. Cardio training exercise apparatuses can include, without limitation, stationary bikes, treadmills, elliptical machines, stair climbers, rowing machines and the like. Strength training exercise apparatuses can include, without limitation, multi-station machines, circuit machines, home-gym machines, universal machines, and the like. Referring to FIG. 21, a fitness tracking computing 2180 is depicted that may be functionally similar to the fitness tracking computing system 2080 of FIG. 20. The fitness tracking computing system 2180, however, is in networked communication with a plurality of exercise sites 2175A-N. Each of the exercise sites 2175A-N has one or more exercise apparatuses 2100A-N that are each augmented with sensor devices 2160A-N. Furthermore, the fitness tracking computing system 2180 can have awareness regarding the type of exercises that can be completed at each exercise site 2175A-N. In this regard, for example, the exercise site 2175A may be a commercial fitness center with a wide array of exercise apparatuses, where the exercise site 2175B may be a small fitness center at a community recreation center. Thus, for a user with a particular fitness routine stored by the fitness tracking computing system 2180, based on the exercise site 2175A-N at which the user is exercising, the fitness tracking computing system 2180 can adapt and modify the fitness routine based on the types of exercise apparatus available to the user.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these sorts of focused discussions would not facilitate a better understanding of the present invention, and therefore, a more detailed description of such elements is not provided herein.

Any element expressed herein as a means for performing a specified function is intended to encompass any way of performing that function including, for example, a combination of elements that performs that function. Furthermore the invention, as may be defined by such means-plus-function claims, resides in the fact that the functionalities provided by the various recited means are combined and brought together in a manner as defined by the appended claims. Therefore, any means that can provide such functionalities may be considered equivalents to the means shown herein. Moreover, the processes associated with the present embodiments may be executed by programmable equipment, such as computers. Software or other sets of instructions that may be employed to cause programmable equipment to execute the processes may be stored in any storage device, such as, for example, a computer system (non-volatile) memory, an optical disk, magnetic tape, or magnetic disk. Furthermore, some of the processes may be programmed when the computer system is manufactured or via a computer-readable memory medium.

It can also be appreciated that certain process aspects described herein may be performed using instructions stored on a computer-readable memory medium or media that direct a computer or computer system to perform process steps. A computer-readable medium may include, for example, memory devices such as diskettes, compact discs of both read-only and read/write varieties, optical disk drives, and hard disk drives. A non-transitory computer-readable medium may also include memory storage that may be physical, virtual, permanent, temporary, semi-permanent and/or semi-temporary.

These and other embodiments of the systems and methods can be used as would be recognized by those skilled in the art. The above descriptions of various systems and methods are intended to illustrate specific examples and describe certain ways of making and using the systems disclosed and described here. These descriptions are neither intended to be nor should be taken as an exhaustive list of the possible ways in which these systems can be made and used. A number of modifications, including substitutions of systems between or among examples and variations among combinations can be made. Those modifications and variations should be apparent to those of ordinary skill in this area after having read this disclosure.

What is claimed is:

1. A sensor device for exercise data tracking, comprising:

a housing, wherein an accelerometer coupled to the housing, wherein the accelerometer is to generate data based on movement of the housing;

a wireless communication system is coupled to the housing, wherein the wireless communication system is to wirelessly transmit the data to a receiver; and a power supply is in communication with the wireless communication system and the accelerometer;

a mounting clip, wherein the mounting clip defines a surface to be coupled to an exercise apparatus, the housing can be selectably coupled to the mounting clip, and an orientation of the housing relative to the mounting clip is maintained while in the housing is coupled to the mounting clip.

2. The sensor device of claim 1, wherein the housing defines a detent.

3. The sensor device of claim 2, wherein the mounting clip comprises a latch configured to engage the detent when the housing is coupled to the mounting clip.

4. The sensor device of claim 1, further comprising a gyroscope coupled to the housing.

5. The sensor device of claim 1, further comprising a LiDAR sensor coupled to the housing.

6. The sensor device of claim 1, further comprising a gyroscope coupled to the housing.

7. The sensor device of claim 1, wherein the power supply is replaceable.

8. The sensor device of claim 1, wherein the power supply is rechargeable.

9. The sensor device of claim 1, wherein the housing comprises an indicator.

10. The sensor device of claim 9, wherein the indicator is any of a light emitting device and an audible device.

11. A method, comprising:

coupling a mounting clip to an exercise apparatus;

coupling a housing to the mounting clip, wherein at least one sensor is coupled to the housing, wherein the at least one sensor is to generate data based on movement of the housing when an exercise is performed on the exercise apparatus, wherein a wireless communication system coupled to the housing, wherein the wireless communication system is to wirelessly transmit the data to a receiver, and wherein a power supply is in communication with the wireless communication system and the at least one sensor; and subsequent to coupling the housing to the mounting clip, calibrating the at least one sensor based on the exercise performed on the exercise apparatus, wherein calibrating the at least one sensor comprises determining outputs of the at least one sensor during a stroke of the exercise apparatus during the exercise performed on the exercise apparatus.

12. The method of claim 11, wherein the stroke of the exercise apparatus is a linear stroke.

13. The method of claim 11, wherein the stroke of the exercise apparatus is a rotational stroke.

14. The method of claim 11, further comprising:

subsequent to calibration, collecting exercise data from the use of the exercise apparatus, wherein the exercise data comprises any of a selected weight amount, a number of repetitions, a number of sets, a stroke distance, and a stroke speed.

15. An exercise apparatus, comprising:

a resistance assembly, wherein the resistance assembly has a user-selective resistance;

a flexible member coupled to the resistance assembly;

an interaction member coupled to the flexible member;

a sensor device coupled to the interaction member, the sensor device comprising a mounting clip and a housing removably coupled to the mounting clip, wherein an orientation of the housing relative to the mounting clip is maintained while the housing is coupled to the mounting clip, wherein the sensor device comprises:

at least one sensor is coupled to the housing, wherein the at least one sensor is to generate data based on movement of the interaction member;

a wireless communication system is coupled to the housing, wherein the wireless communication system is to wireless transmit the data to a receiver; and a power supply is in communication with the wireless communication system and the at least one sensor.

16. The method of claim 15, wherein the housing defines a detent.

17. The method of claim 16, wherein the mounting clip comprises a latch configured to engage the detent when the housing is coupled to the mounting clip.

18. The method of claim 15, wherein the at least one sensor comprises any of an accelerometer, a gyroscope, and a LiDAR sensor.

19. The method of claim 15, wherein the power supply is replaceable.

20. The method of claim 15, wherein the power supply is rechargeable.

21. A sensor device for exercise data tracking, comprising:

a housing, a sensor, wherein the sensor is any of an accelerometer, a gyroscope, and a LiDAR sensor, wherein the sensor coupled to the housing, wherein the sensor is to generate data based on movement of the housing;

a wireless communication system, wherein the wireless communication system is to wirelessly transmit the data to a receiver, wherein the wireless communication system is coupled to the housing; and a power supply is in communication with the wireless communication system and the sensor;

a mounting clip, wherein the mounting clip defines a surface to be coupled to an exercise apparatus, the housing can be selectably coupled to the mounting clip, and an orientation of the housing relative to the mounting clip is maintained while in the housing is coupled to the mounting clip.

* * * * *